US010370876B2

(12) United States Patent
Farrenkothen

(10) Patent No.: US 10,370,876 B2
(45) Date of Patent: Aug. 6, 2019

(54) LOCALLY AND REMOTELY ACTUABLE VEHICLE DOOR LOCK

(71) Applicant: D. La Porte Sohne GmbH, Wuppertal (DE)

(72) Inventor: Ralf Farrenkothen, Solingen (DE)

(73) Assignee: D. La Porte Sohne GmbH, Wuppertal (DE)

( * ) Notice: Subject to any disclaimer, the term of this patent is extended or adjusted under 35 U.S.C. 154(b) by 784 days.

(21) Appl. No.: 15/004,138

(22) Filed: Jan. 22, 2016

(65) Prior Publication Data

US 2016/0215532 A1 Jul. 28, 2016

(30) Foreign Application Priority Data

Jan. 22, 2015 (DE) ..... 10 2015 000 750

(51) Int. Cl.
*E05C 3/12* (2006.01)
*E05B 53/00* (2006.01)
(Continued)

(52) U.S. Cl.
CPC ..... *E05B 79/22* (2013.01); *E05B 79/20* (2013.01); *E05B 81/02* (2013.01); *E05B 83/00* (2013.01);
(Continued)

(58) Field of Classification Search
CPC ..... E05B 79/22; E05B 79/20; E05B 81/02; E05B 83/00; E05B 83/42; E05B 85/245; E05B 85/247; E05B 53/00; E05B 85/26; E05B 85/10; E05C 3/124; E08B 85/12; Y10T 292/108; Y10T 292/1082;
(Continued)

(56) References Cited

U.S. PATENT DOCUMENTS 1,059,952 A * 4/1913 Spooner ..... E05B 85/16 292/226
3,666,305 A * 5/1972 Schlichter ..... E05B 85/247 292/216
(Continued)

FOREIGN PATENT DOCUMENTS

CN 201190477 Y 2/2009
CN 203766455 U 8/2014
(Continued)

*Primary Examiner* — Kristina R Fulton
*Assistant Examiner* — Faria F Ahmad
(74) *Attorney, Agent, or Firm* — Eric J. Sosenko; Jonathan P. O'Brien; Honigman LLP

(57) ABSTRACT

A vehicle door lock having a rotary latch arrangement and a release mechanism. The rotary latch arrangement includes a lock case in which a pivoted rotary latch and a pivoted locking pawl are arranged. The release mechanism includes a first release device with a traverse tube, a cable pull mechanism with a traction element led through the traverse tube and means for actuating the cable pull mechanism, and a pivotable actuation lever that engages in the lock case and which comprises two opposite actuation lever lateral surfaces. The actuation lever is rotatably connected with the first release device to be driven about an actuation lever rotary axis, wherein the locking pawl can be actuated by rotating the actuation lever so that the locking mechanism of the rotary latch can be released.

26 Claims, 13 Drawing Sheets

(51) Int. Cl.

| | |
|---|---|
| ***E05B 79/20*** | (2014.01) |
| ***E05B 79/22*** | (2014.01) |
| ***E05B 81/02*** | (2014.01) |
| ***E05B 83/00*** | (2014.01) |
| ***E05B 83/42*** | (2014.01) |
| ***E05B 85/12*** | (2014.01) |
| ***E05B 85/24*** | (2014.01) |
| ***E05B 85/26*** | (2014.01) |

(52) U.S. Cl.
CPC ..... *E05B 83/42* (2013.01); *E05B 85/245* (2013.01); *E05C 3/124* (2013.01); *E05B 53/00* (2013.01); *E05B 85/12* (2013.01); *E05B 85/247* (2013.01); *E05B 85/26* (2013.01); *Y10T 292/108* (2015.04); *Y10T 292/1044* (2015.04); *Y10T 292/1047* (2015.04); *Y10T 292/1076* (2015.04); *Y10T 292/1082* (2015.04); *Y10T 292/57* (2015.04)

(58) Field of Classification Search
CPC ..... Y10T 292/1047; Y10T 292/57; Y10T 292/1076; Y10T 292/1044
USPC ..... 292/216, 196, 201, DIG. 23, 213, 336.3
See application file for complete search history.

(56) References Cited

U.S. PATENT DOCUMENTS 3,858,916 A * 1/1975 Torii ..... E05B 85/247 292/45
6,942,259 B2 * 9/2005 Marzolf ..... E05B 85/247 292/216
7,097,216 B2 * 8/2006 Lane ..... E05B 85/14 292/216
7,111,879 B2 * 9/2006 Zweibohmer ..... E05B 85/10 292/336.3
7,198,308 B2 * 4/2007 Lane ..... E05B 79/12 292/336.3
7,338,097 B2 * 3/2008 Marzolf ..... E05B 63/14 292/11
7,988,210 B2 * 8/2011 Shibata ..... B60J 5/0487 16/82
8,011,699 B2 * 9/2011 Lane ..... E05B 85/10 292/336.3
8,091,933 B1 * 1/2012 Hemann ..... E05B 63/185 292/198
8,226,129 B2 * 7/2012 Okunaka ..... B62D 33/071 292/11
8,276,950 B2 * 10/2012 Kutschat ..... E05B 85/247 292/201
8,360,483 B2 * 1/2013 Koppel ..... E05B 83/16 292/216
8,672,386 B2 * 3/2014 Yoo ..... B60N 2/01583 292/216
8,770,635 B2 * 7/2014 Schwickerath ..... E05B 5/006 292/116
8,827,327 B2 * 9/2014 Kutschat ..... E05B 85/247 292/196
8,894,105 B2 * 11/2014 Kutschat ..... E05B 79/04 292/173
9,221,319 B2 * 12/2015 Kato ..... B60J 5/0487
9,273,498 B2 * 3/2016 Kato ..... E05B 79/20
2001/0006293 A1 * 7/2001 Rupp ..... E05B 65/1053 292/336.3
2004/0113433 A1 * 6/2004 Marzolf ..... E05B 85/247 292/201
2004/0113434 A1 * 6/2004 Lane ..... E05B 85/14 292/201
2004/0113435 A1 * 6/2004 Marzolf ..... E05B 85/247 292/201
2004/0113440 A1 * 6/2004 Zweibohmer ..... E05B 85/10 292/336.3
2004/0113441 A1 * 6/2004 Lane ..... E05B 85/10 292/336.3
2004/0140678 A1 * 7/2004 Linares ..... E05C 3/24 292/216
2004/0262928 A1 * 12/2004 Fukunaga ..... E05B 79/04 292/216
2005/0093306 A1 * 5/2005 Pudney ..... E05B 85/16 292/216
2005/0206172 A1 * 9/2005 Bacon ..... E05B 17/0004 292/216
2007/0262591 A1 * 11/2007 Wright ..... E05B 77/04 292/216
2009/0134638 A1 * 5/2009 Kutschat ..... E05B 85/247 292/216
2010/0045052 A1 * 2/2010 Kutschat ..... E05B 85/247 292/196
2011/0095546 A1 * 4/2011 Russell ..... E05B 77/04 292/216
2012/0267905 A1 * 10/2012 Debroucke ..... E05B 15/04 292/336.3
2014/0217770 A1 * 8/2014 Hirukawa ..... E05B 85/18 296/146.1
2014/0239650 A1 * 8/2014 Kato ..... B60J 5/0487 292/336.3
2015/0218855 A1 * 8/2015 Kato ..... E05B 79/20 292/336.3

FOREIGN PATENT DOCUMENTS

| | | | |
|---|---|---|---|
| DE | 19952012 | A1 | 5/2001 |
| DE | 10343355 | A1 | 7/2004 |
| DE | 102005016253 | A1 | 11/2005 |
| DE | 102006012956 | A1 | 3/2007 |
| DE | 202007005292 | U1 | 6/2007 |
| DE | 202008005129 | U1 | 7/2008 |

* cited by examiner

LOCALLY AND REMOTELY ACTUABLE VEHICLE DOOR LOCK

FIELD OF THE INVENTION

The invention relates to a vehicle door lock for locking and closing doors of motor vehicles, in particular doors of agricultural machines, for example tractors, having a rotary latch arrangement and a release mechanism for the rotary latch arrangement, which has a first, remotely actuable and a second, locally actuable release device, wherein the remotely actuable release device has a traverse tube with built-in remotely actuable release means, a remote-control actuation button and a cable pull mechanism which is operatively connected with the remote-control release means. In the context of the present invention, the term remotely actuable means that the actuation mechanism of the release device, i.e., the remote-control actuation button, is not directly mounted at the lock case.

BACKGROUND

For example, such a vehicle door lock is disclosed in DE 199 52 012 A1. It has a flat, cube-shaped lock case with a recess for a locking bolt, wherein in the lock case there are two rotatably mounted rotary latches, which are spring-supported in an opening direction of rotation and which encompass or release the locking bolt, and a pivotable locking pawl, by means of which it is possible to block the rotary motion of the rotary latches and to close the lock. For this purpose, the locking pawl has two lever arms facing each other approximately at a right angle and is pivoted in the angular range in which the two lever arms are connected. Moreover, at the end of one of the two lever arms a latching piece has been provided, which has a counter-toothing arrangement corresponding to the toothing arrangements of the opposite rotary latches and engages in the latching gaps of these toothing arrangements when the rotary latch members are encompassed. A release mechanism of the door lock has a locally actuable release device and a remotely actuable release device, by means of which the locking pawl can be actuated, so that the locking mechanism of the rotary latches can be released. The locally actuable release device has a locally actuable release lever, which can be actuated by pulling a door handle, wherein the locally actuable release lever is in direct operative connection with the locking pawl in the region of the lever arm having the latching piece. The remote controlled release device has a traverse tube that can be rotated toward the lock case, in which a remote-control actuation button that protrudes over a tube shell is arranged. Said remote-controlled actuation button is operatively connected with remote-control actuation means arranged inside the traverse tube. Via a pulling cable or a rod, which extends inside the traverse tube, said remote-control actuation means, in turn, are operatively connected with a pivotable remote-control release lever arranged at an end of the traverse tube facing the lock. By means of the remote-control release lever, which is in direct operative connection with the locking pawl in the region of the lever arm that does not have the latching piece, the locking pawl is actuated. By arranging the remote-control actuation means and remote-control actuation device in such a way that it can be moved in longitudinal direction and fixed at the traverse tube, it can be ensured that the traverse tube can be rotated toward the lock case and the position of the remote-control actuation means and the remote-control actuation device can be adapted to the pivot angle. Furthermore, at the end of the traverse tube facing away from the lock, the traverse tube has a tube crimp provided with a longitudinal hole, and by means of said tube crimp the traverse tube can be screwed to frame struts of the vehicle door.

DE 10 2005 016 253 A1 discloses a remotely actuable release device of a generic vehicle door lock. In this release device, the traverse tube has, instead of the tube crimp, an internally threaded body, which is fixedly inserted into the end of the traverse tube and which has a threaded hole preferably extending in axial direction in the traverse tube, into which a retaining screw is screwed, which penetrates a clamp body and the frame strut to which the tube is attached. At the same time, the clamp body is set against the front end of the traverse tube arranged vertically to the longitudinal axis of the traverse tube, wherein the clamp body has also a planar contact surface opposite to the front end of the traverse tube. This fixing arrangement can be easily adapted to the respective course of a frame strut and is easy to assemble.

DE 20 2007 005 292 U1 discloses a vehicle door lock, which has a rotary latch arrangement and a release mechanism, by means of which the rotary latch arrangement can be unlocked. The rotary latch arrangement has a lock case comprising a recess for a locking bolt in which at least one rotary latch is pivoted, wherein the rotary latch is drivably connected with a rotary latch spring. Moreover, in the lock case at least one pivotable locking pawl is arranged by means of which the rotary motion of the rotary latch can be blocked, thus locking the rotary latch arrangement. The release mechanism has a locally actuable release device and a remotely actuable release device with a traverse tube which has built-in remote-control release means, a remote-control actuation button and a cable pull mechanism which is operatively connected with the remote-control release means. The locking pawl can be actuated with the locally actuable release device, as well as with remotely actuable release device, so that the locking mechanism can be released, wherein the release mechanism comprises an actuation lever, by means of which the locking pawl can be actuated, and which can be actuated by means of the locally actuable release device, as well as by means of the remotely actuable release device.

This well-known locally and remotely actuable door lock has stood the test of time.

SUMMARY

Therefore, it is the object of the present invention to provide a door lock of the type mentioned above, which has a locally and remotely actuable release device and which is improved with respect to sturdiness, assembly capacity and functional reliability.

The problem is solved with the characteristics of claim 1. Advantageous further developments of the invention are shown in the sub-claims.

BRIEF DESCRIPTION OF THE DRAWINGS

Subsequently, the invention is described in more detail by means of drawings used in an exemplary manner and in which it is shown.

DETAILED DESCRIPTION

Figure 8:
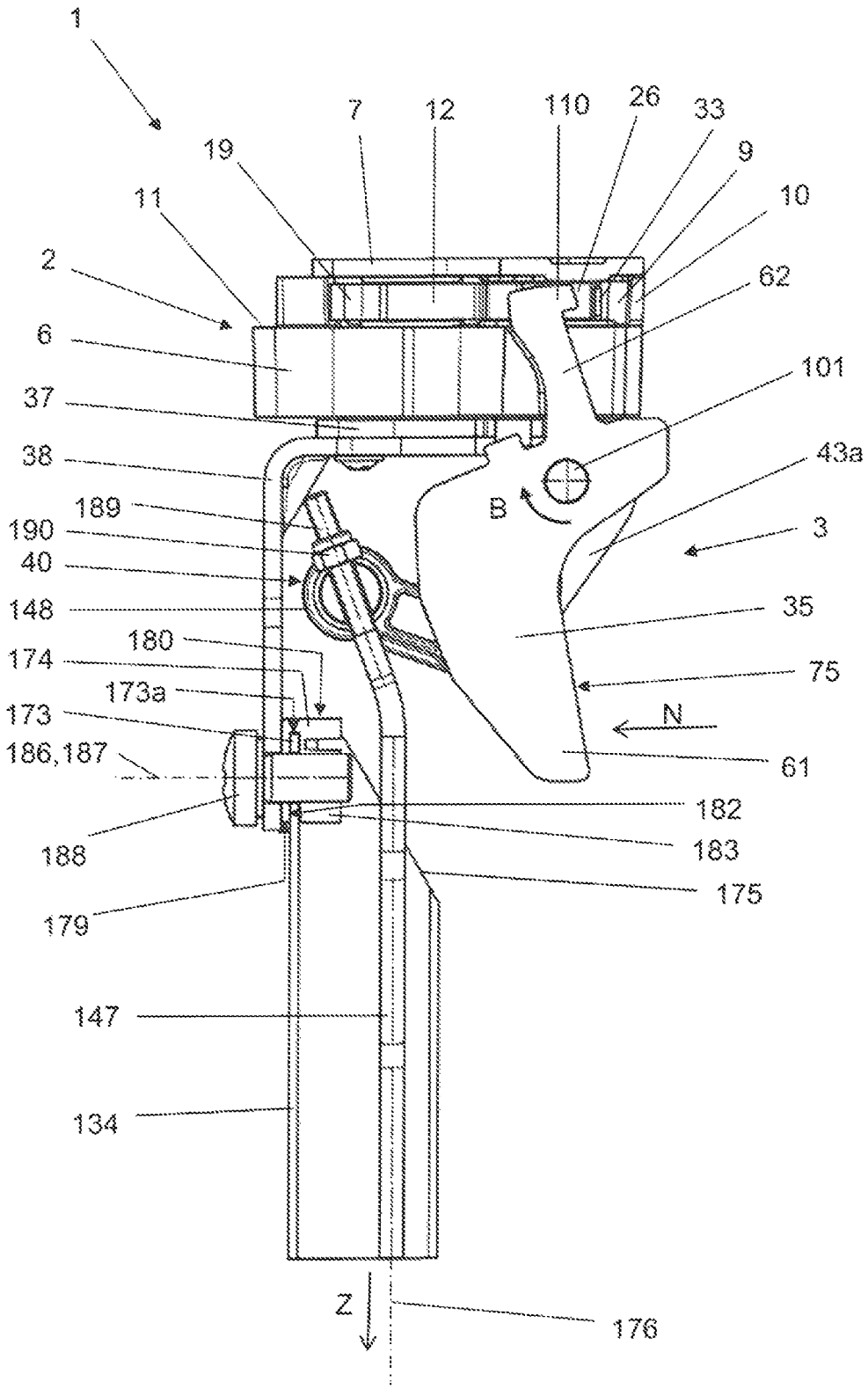
FIG. 8 is a sectional lateral view of the door lock shown in FIG. 1 in mounted condition (with closed rotary latches)
Figure 9:
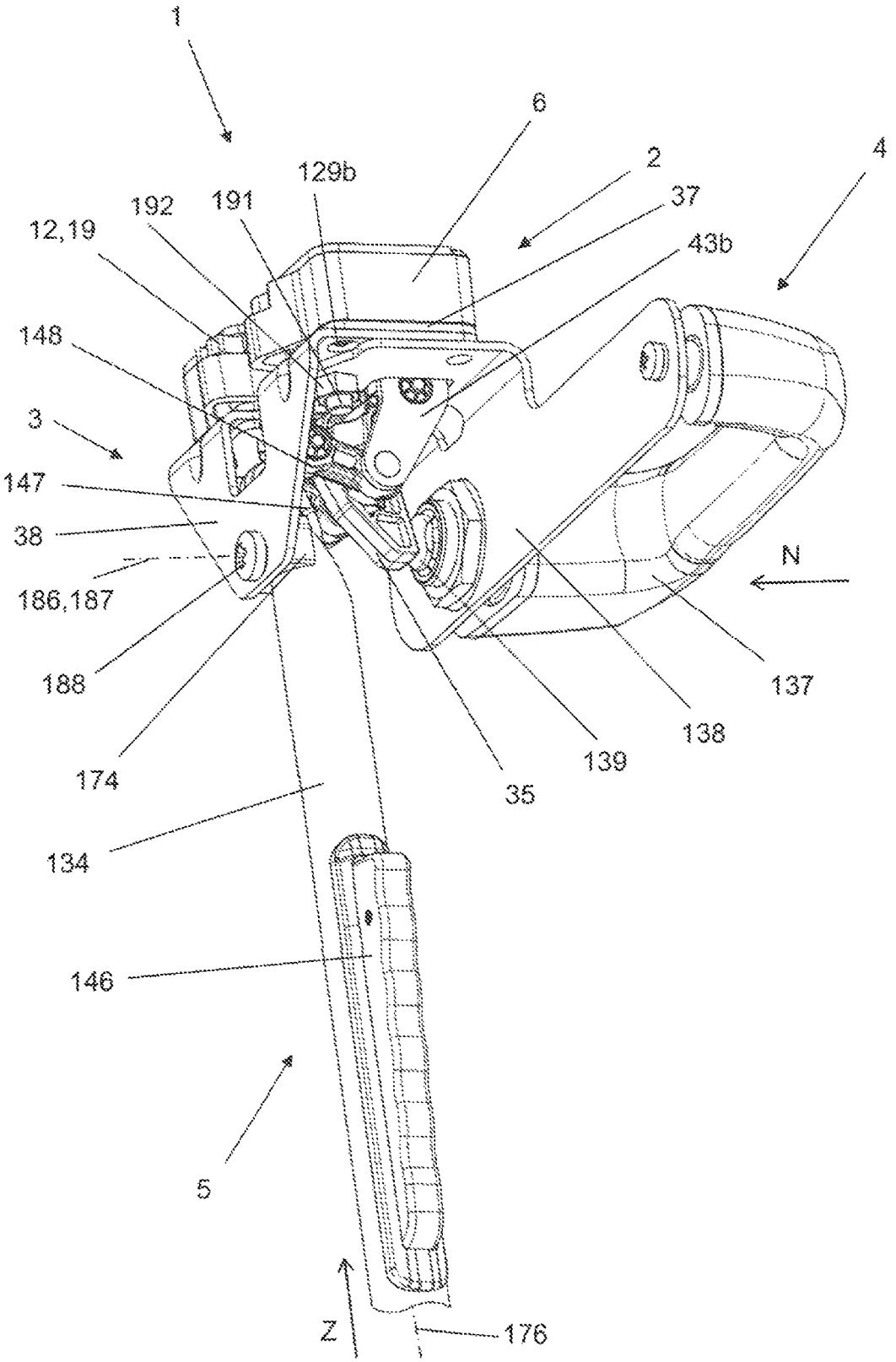
FIG. 9 is an isometric view of the door lock shown in FIG. 1 in mounted condition.

The door lock 1 (FIGS. 1, 8, 9), embodying the principles of the present invention, has a rotary latch arrangement 2 and a release mechanism 3 with a locally and a remotely actuable release device 4, 5 for respectively unlocking the rotary latch arrangement 2.

The rotary latch arrangement 2 (FIGS. 1, 2, 8-13) known from DE 10 2006 012 956 A1, to which we are referring in this context, has a basically cube-shaped lock case 6. The lock case 6 comprises a planar baseplate or rear panel 7, a cover 8 or front panel 8 arranged opposite of the baseplate 7 and basically parallel to the baseplate, two upright transverse walls 9 extending parallel to each other and vertical to the baseplate 7 and the cover 8, as well as a longitudinal wall 10 extending vertically to the baseplate 7 and the transverse wall 9. Furthermore, the lock case 6 has a longitudinal wall 11 extending vertically to the baseplate 7 and the cover 8. Preferably, the longitudinal wall 11 connects to the two transverse walls 9 perpendicularly. The lock case 6 serves the purpose of receiving a well-known locking mechanism, which has two rotary latches 12. Furthermore, the lock case 6 has a V-shaped locking bolt recess 13, which extends from the longitudinal wall 11 into the cover 8 and the baseplate 7, through which recess it is possible to move a locking bolt 14 (FIG. 1) into the lock case 6 and out of the lock case 6. In addition, the lock case 6 preferably has two drill holes 15 with internal thread in the cover 8 for attaching the lock case 6 at the release mechanism 3. Especially preferred, the drill holes 15 are arranged in the corner segment between the longitudinal wall 11 and the transverse wall 9.

Figure 13A:
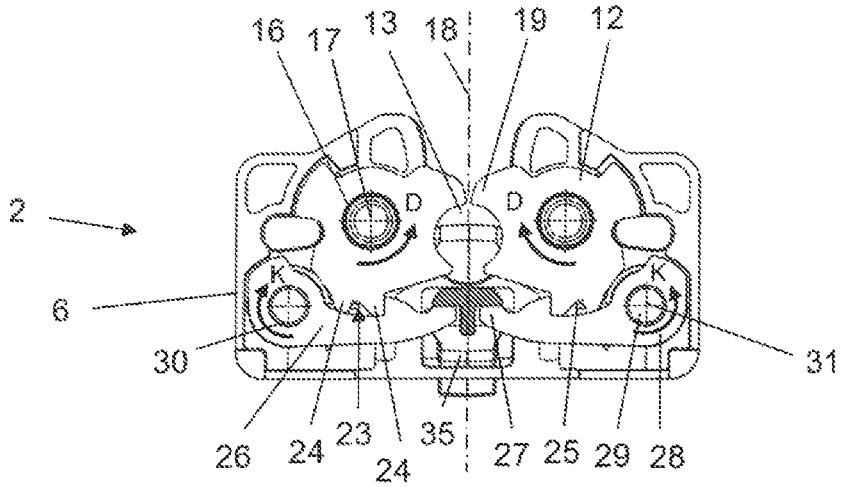
FIG. 13*a* is a cover-sided view on a rotary latch arrangement of the door lock without cover of a lock case with closed rotary latch lock.

Preferably, a section of the longitudinal wall 11 extends in V-shaped manner to the outside or away from the lock case 6, when viewed in the direction of the locking bolt recess 13, so that in opened position (FIG. 13*c*), as well as in closed position (FIG. 13*a*), the rotary latches 12 do not protrude out of the lock case 6, i.e., they are arranged inside the lock case 6. Each of the rotary latches 12 is pivoted on a hollow-cylindrical rotary latch mounting bolt 16 provided in a rotary latch mounting hole 16a. Advantageously, each of the rotary latch mounting bolts 16 is firmly connected with the baseplate 7 and has a mounting bolt axis or rotary axis 17, which extends vertically to the baseplate 7. Preferably, both rotary latches 12 are spaced from each other in relation to a transverse central plane 18 of the rotary latch arrangement 2. Preferably, the rotary latches 12 planar elements, for example, steel plates, which extend parallel to the baseplate 7. Each rotary latch 12 comprises a locking lug 19 with a groove 20. The grooves 20 are facing each other and serve the purpose of receiving the locking bolt 14, which extends vertically to the baseplate 7 and is preferably designed in the form of a cylinder, which is subsequently described in more detail. Each of the rotary latches 12 is spring-loaded with a spring 21, which have the object of keeping the rotary latches 12 in opened position, i.e., pushing apart the locking lugs 19 facing each other. Thus, each of the rotary latches 12 is drivably connected with a respective spring 21 in an opening direction D about the rotary axis 17 (FIG. 13*a*).

Furthermore, a perimeter wall or peripheral edge 22 of the rotary latches 12 basically comprises opposite of the locking lugs 19 a respective toothing arrangement 23 preferably having two latches 24, respectively, and an intermediate depression 25 for a latch. In a generally known manner, the toothing arrangement 23 serves the purpose of locking the rotary latches 12 in their completely closed or preloaded position by means of a respective locking lever or locking pawl 26.

Preferably, the two elongated locking pawls 26 have also a planar design and extend parallel to the baseplate 7, wherein a respective locking pawl actuating portion 27 is provided on one end and a respective locking pawl mounting portion 28 on the other end. Each locking pawl mounting portion 28 has a continuous locking pawl mounting drill hole 29, with which the locking pawls 26 are pivoted about a rotary axis 31 on preferably hollow cylindrical mounting bolts 30. At the same time, both mounting bolts 30 are also firmly connected with the baseplate 7 and the rotary axis 31 extends vertically to the baseplate 7. Furthermore, both mounting bolts 30 are symmetrically spaced from each other in corner segments respectively formed by the transverse walls 9 and the longitudinal wall 10 symmetrisch in relation to the transverse central plane 18 of the door lock 1, so that the locking pawls 26 are also designed and arranged in symmetrical manner to the transverse central plane 18.

Figure 13B:
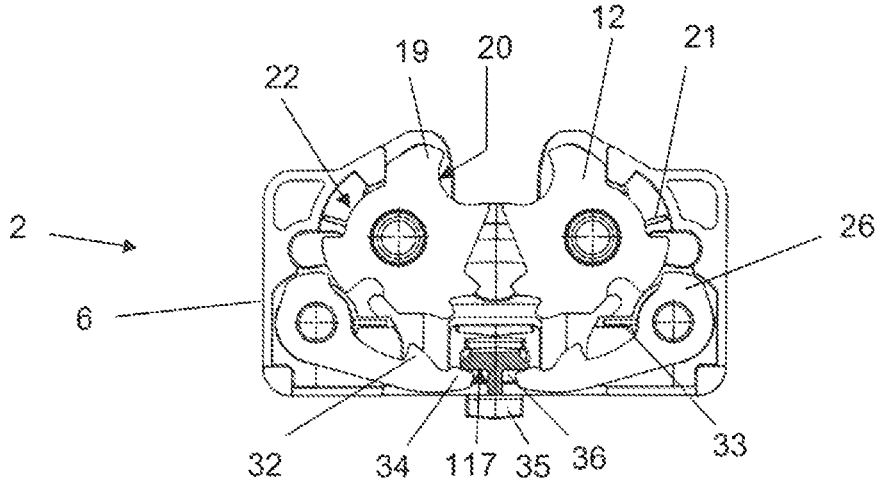
FIG. 13*b* is a cover-sided view on the rotary latch arrangement of the door lock without cover of the lock case, in which the actuation lever is in release position for opening the rotary latch lock.
Figure 13C:
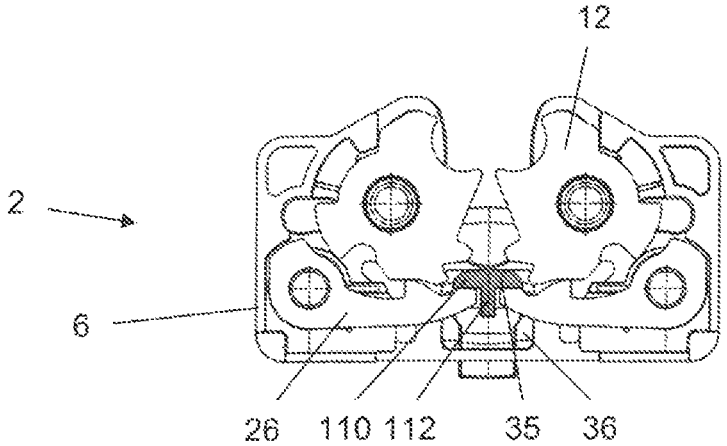
FIG. 13*c* is a cover-sided view on the rotary latch arrangement of the door lock without cover of the lock case with open rotary latch lock.

The actuating portion 27 of both locking pawls 26 has a respective integrally molded latch 32, each of which is formed in such a way that it faces the rotary latch 12 to be locked and that is able to engage in the toothing arrangement 23 of the rotary latch 12 in order to lock it. At the same time, the locking pawls 26 are spring-loaded with a respective spring 33, which comprises preferably a leg torsion spring, so that the locking pawl latches 32 are pushed in the direction of the rotary latches 12 or against the perimeter wall 22 of the rotary latches 12. As a result, the locking pawls 26 are drivably connected with one locking pawl spring 33, respectively, about the rotary axis 31 against a locking pawl actuating direction (FIG. 13*a*, 13*b*, 13*c*).

At the end of the locking pawls 26 on the side of the actuating portion, a respective actuating or support projection 34 is provided, which extends also in the direction of the rotary latches 12. This actuating projection 34 is used as a support and gripping surface for an actuation lever 35 of the release mechanism 3, with which the locking pawls 26 can be rotated about the locking pawl mounting bolts 30 in locking pawl actuating direction K, in order to unlock the rotary latches 12. This is subsequently described in more detail.

Furthermore, a lever pass-through recess 36 is provided in the cover 8 of the lock case 6. Preferably, the lever pass-through recess 36 basically has a cube-shaped design and is arranged centrally in relation to the transverse central plane 18, and it is arranged in the region of both actuating projections 34 of the locking pawls 26. By means of the lever pass-through recess 36 the actuation lever 35 engages in the lock case 6 and on the actuating projections 34, which is subsequently described in more detail.

The release mechanism 3 of the invention-based door lock 1 comprises the second or locally actuable release device 4, i.e., the release device 4, which an operator would actuate in the close vicinity of the rotary latch arrangement 2 to be actuated. It also comprises the first or remotely actuable release device 5, which an operator would actuate at a distance from the rotary latch arrangement 2 to be actuated. In addition, it comprises the actuation lever 35, which is, or can be brought, in direct operative connection with both release devices 4, 5 and the locking pawls 26 of the rotary latch arrangement 2 to be actuated, as well as a mounting plate 37 and an angular metal sheet 38 for supporting components of the release mechanism 3 and for attaching the release mechanism 3 on the cover 8 of the lock case 6.

Preferably, the mounting plate 37 (FIG. 1, 3, 4) has a two-piece design and has two mounting plate elements 39*a*, 39*b*, which are spaced from each other and which are preferably symmetrically identical. Said mounting plate elements 39*a*, 39*b* have the purpose of rotatably supporting the actuation lever 35 of the locally actuable release device 4 and rotatably supporting a drive bracket 40 of the remotely acuated release device 5 and of attaching the release mechanism 3 on the lock case 6.

The mounting plate elements 39*a*, 39*b* have, respectively, two leg plates, which preferably face each other at a right angle, and which are connected, respectively, with each other at a mounting late edge 41*a*, 41*b*. In particular, each of the leg plates is designed in the form of a fitting or connection section 42*a*, 42*b* for attachment on the lock case 6, as well as in the form of a support leg or support lug 43*a*, 43*b* for supporting the actuation lever 35 and the drive bracket 40. Furthermore, the mounting plate elements 39*a*, 39*b* have a respective first upper side or element interior side 44*a, b*, as well as a second upper side or element exterior side 45*a, b*. At the same time, the element interior sides 44*a, b* form a mounting plate interior side 46 and the element exterior sides 45*a, b* form a mounting plate exterior side 47. Furthermore, the mounting plate elements 39*a*, 39*b* have, respectively, a first continuous, preferably cylindrical mounting recess 48*a*, 48*b*, which extends vertically to the mounting plate 37. In addition, the mounting plate elements 39*a*, 39*b* have, respectively, a continuous, in particular cylindrical, second mounting recess 49*a*, 49*b*, which extends virtically to the mounting plate 37 and preferably a continuous, in particular cylindrical third mounting recess 50*a*, 50*b*, which extends vertically to the mounting plate 37. Furthermore, a lever pass-through recess 52 preferably extending from one longitudinal edge 51 of the mounting plate 37 to the opposite longitudinal edge is provided between the two mounting plate elements 39*a*, 39*b*, which are spaced from each other. The lever pass-through recess 52 basically extends centrally in relation to the mounting recesses 48, 49, 50.

The first mounting recesses 48*a*, 48*b* are corresponding with the rotary latch mounting bolts 16 of the rotary latch arrangement 2, i.e., in mounted condition of the door lock 1, the first mounting recesses 48 are arranged coaxially to the rotary latch mounting holes 16*b*. Advantageously, in well-known manner, one cylindrical connector socket (not shown), respectively, having the socket edge protruding over the interior side 46 of the mounting plate 37 and having an internal thread is inserted in the mounting recesses 48*a*, 48*b* 46. The connector socket is inserted in the mounting recesses 48*a*, 48*b* from the interior side 46 and preferably the socket edge is welded onto the interior side 46, so that the connector socket is firmly connected with the mounting plate 37. The second mounting recesses 49*a*, 49*b* are corresponding with the first lock case drill holes 15, so that in mounted condition of the door lock 1 the second mounting recesses 49*a*, 49*b* are aligned with the lock case drill holes 15. The third mounting recesses 50*a*, 50*b* are corresponding with the second lock case drill holes (not shown), so that in mounted condition of the door lock 1 the third mounting recesses 50*a*, 50*b* are aligned with the second drill holes of the lock case 6. The assembly is subsequently described in more detail.

The support lugs 43*a*, 43*b* are extending, respectively, vertically from the mounting leg 42*a*, 42*b* of the respective mounting element 39*a*, 39*b* in the direction of the interior side of the mounting plate 46. The first support lug 43*a* has two lateral surfaces 54*a* extending parallel to each other and vertically to the mounting leg 42*a*, as well as a circumferential side edge of the lug 55*a* extending vertically to the lateral surfaces of the lug 54*a*. At the free end of the support lug 43*a*, the side edge of the lug 55*a* is preferably designed in the form of a rounded corner edge 56*a*. Analogous to the first support lug 43*a*, the second support lug 43*b* has two lateral surfaces 54*b* extending parallel to each other and vertically to the mounting leg 42*b*, as well as a circumferential side edge 55*b* extending vertically to the lateral surfaces 54*b*. At the free end of the second support lug 43*b*, the side edge of the lug 55*b* is preferably designed in the form of a rounded corner edge 56*b*.

Furthermore, each of the two support lugs 43*a*, 43*b* has preferably a circumferential, in particular a cylindrical, first lug support recess or an actuation lever support recess 57*a*, 57*b*, which has a recess axis that extends vertically to the respective support lug 43*a*, 43*b*, in particular to the lateral surfaces of the lug 54*a*, 54*b*, representing an actuation lever rotary axis 58. In addition, each of the two support lugs 43*a*, 43*b* has a preferably circumferential, in particular cylindrical, second lug support recess or drive lever support recess 59*a*, 59*b*, which has a recess axis that extends vertically to the support lug 43*a*, 43*b*, in particular to the lateral surfaces of the lug 54*a*, 54*b*, representing a drive lever rotary axis 60.

Preferably, each of the two support lugs 43*a*, 43*b* is connected in a bent edge 41*a*, 41*b* with the mounting leg 42*a*, 42*b* or is merging via the bent edge 41*a*, 41*b* in the mounting leg 42*a*, 42*b*. However, the scope of the invention can involve also that the support lugs 43*a*, 43*b* are connected with the mounting leg 42*a*, 42*b* in different ways, for example, by means of welding.

Figure 4:
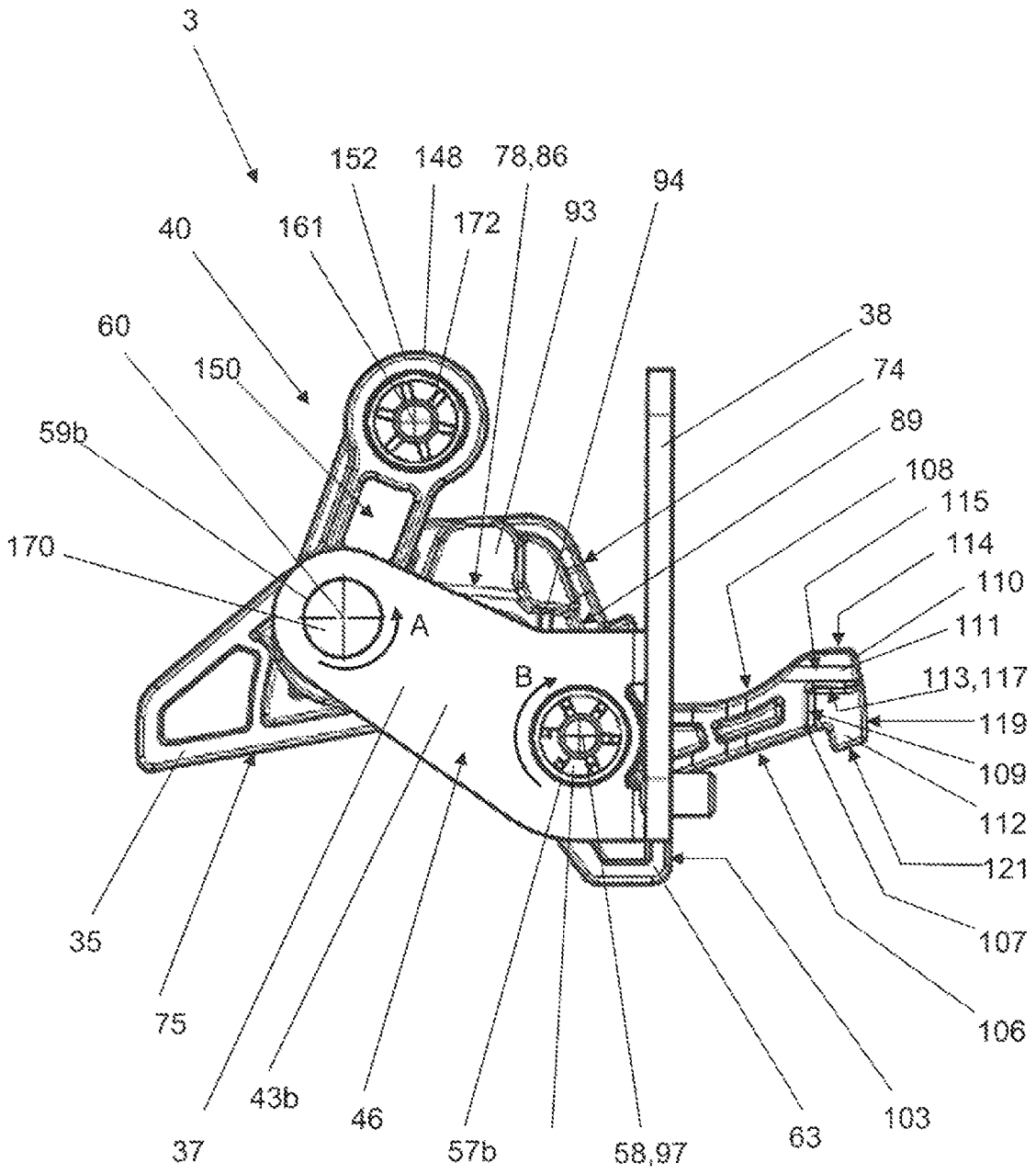
FIG. 4 is a lateral view of the bearing plate shown in FIG. 3.
Figure 5:
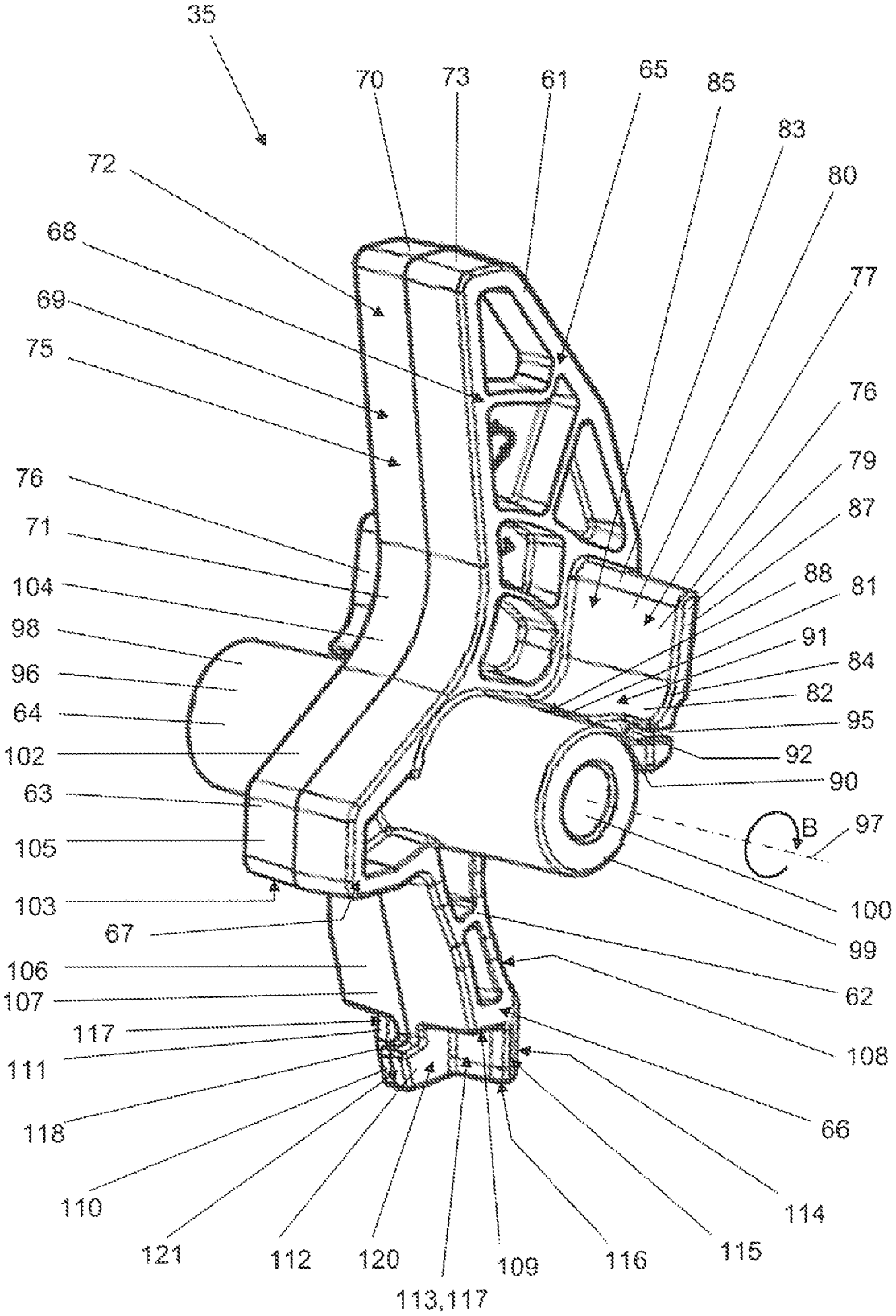
FIG. 5 is an isometric view of the actuation lever shown in FIG. 3.

The actuation lever 35 (FIG. 4) has an actuation lever input arm 61, an actuation lever output arm 62, a stop lug 63, as well as a support section 64 arranged in the transition region of the actuation lever input arm 61, the actuation lever output arm 62 and the stop lug 63. Advantageously, the lateral surfaces 65, 66, 67 of the actuation lever input arm 61, the actuation lever output arm 62 and the stop lug 63 form two mutual actuation lever lateral surfaces 68 and a mutual circumferential actuation lever perimeter wall 69 arranged vertically to the two actuation lever lateral surfaces 68.

The actuation lever input arm 61 is used to drive the actuation lever 35 by means of the locally actuable and remotely actuable release device 4, 5. The elongated actuation lever input arm 61 has a first, free end of the input arm 70 facing away from the actuation lever output arm 62 and a second input arm end 71, facing the actuation lever output arm 62. Furthermore, the actuation lever input arm 61 has a circumferential wall 72 with a first or upper front wall 73, which is formed at the free end of the input arm 70, and a second or bottom front wall 74 arranged on the opposite side and two lateral surfaces 65 arranged opposite to each other, in particular parallel to each other, and especially vertical in relation to the circumferential wall of the input arm 72. A region of the circumferential wall of the input arm 72, which is facing the stop lug and which is arranged at the free end of the input arm 70, forms a driving surface 75 of the actuation lever 35. Furthermore, a region of the circumferential wall of the input arm 72, which faces away from the stop lug 63 and which is arranged at the free end of the input arm 70, arranged especially opposite of the driving surface of the actuation lever 75, is preferably designed in an oblique or inclined manner.

Furthermore, the actuation lever input arm 61 has two extension pieces or strips 76, which are respectively connecting to one of the two lateral surfaces of the input arm 65 and which are sticking out from it. The two extension strips 76 serve the purpose of driving the actuation lever 35 by means of the remotely actuable release device 5, which is subsequently described in more detail. Preferably, the extension strips 76 are respectively arranged at the second end of the input arm 71. Viewed in a vertical direction to the two lateral surfaces of the actuation lever 68, each of the extension strips 76 preferably has a V-shaped course. As a result, the extension strips 76 feature an L-shape. In addition, the two extension strips 76 are arranged symmetrically in relation to the transverse central plane 18 and they are identical.

Each of the two extension strips 76 has an interior surface 77 facing the stop lug 63 and an opposite exterior surface 78. Furthermore, each of the extension strips 76 has a side edge 79. In addition, each of the two extension strips 76 has a first L-shaped leg 80 and a second L-shaped leg 81. Both L-shaped legs 80, 81 are angled toward each other and merging into each other in a bent edge of the strip 82.

Preferably, the first L-shaped leg 80 has a panel-type design and has a first, free leg end 83 and a second leg end 84 facing the bent edge 82. Furthermore, the first L-shaped leg 80 comprises a particularly planar interior surface or strip driving surface 85, which points in the direction of the stop lug 63 and which extends vertically to the lateral surface of the input arm 65 and preferably basically parallel to the actuation lever driving surface 75. The first L-shaped leg 80 also comprises an exterior surface 86, which is arranged opposite of the strip driving surface 85 and particularly parallel to the strip driving surface 85, as well as a side edge 87 arranged vertically to the two above-mentioned surfaces 85, 86. The driving surface 85 and the exterior surface are merging at the free end 83 of the first L-shaped leg 80.

Preferably, the second L-shaped leg 81 has also a panel-type design and comprises a first leg end facing away from the bent edge of the strip 82 and a second leg end facing the bent edge of the strip 82. Furthermore, the second L-shaped leg 81 comprises a preferably vertical interior surface 88 pointing toward the first L-shaped leg 80 and angled toward the strip driving surface 85, and an exterior surface 89 arranged opposite to the interior surface of the leg 88, as well as a side edge 90 arranged vertically to the exterior surface.

The second L-shaped leg 81 is connected on one end, namely the second end, with the first L-shaped leg. At its first end, the second L-shaped leg 81 is integrally molded to or merging with the support section 64. At the same time, the interior surface of the leg 88 is merging via a concave, interior corner edge surface or bent edge surface 91 in the strip driving surface 85. The interior surface of the leg 88, the strip driving surface 85 and the bent edge surface 91 form the continuous interior surface of the strip 77.

Advantageously, the side edge 87 of the first L-shaped leg 80 protrudes over the side edge 90 of the second L-shaped leg 81, wherein both side edges 87, 90 are merging via a stepped shoulder 92.

Preferably, each of the extension strips 76 has also a basically cube-shaped reinforcement rib 93, which is integrally molded in one piece to the exterior surface of the strip 78, in particular the exterior surface of the leg 86, in the region of the bent edge of the strip 82 and to the lateral surface of the input arm 65, and which extends from the exterior surface of the leg 86 and the lateral surface of the input arm 65. The reinforcement rib 93 serves the purpose of stabilizing and reinforcing the first L-shaped leg 80 and mounting a spring element 94. For this purpose, the lateral edge 87 of the first L-shaped leg 80 comprises at the second leg end 84 a mounting slot 95, which is extending from the strip driving surface 85 to the exterior surface 86, and which has a rectangular or semi-circular shape in cross section, for receiving a leg of the spring element 94 or an actuation transition 94.

The support section 64 has two cylinder-tube-shaped bearing bushes 96, each of which is sticking out, especially vertically, from one of the two actuation lever lateral surfaces 68. At the same time, the support section 64 or the two bearing bushes 96 have a support section axis 97, which extends coaxially with the actuation lever rotary axis 58 in mounted condition of the release device 3.

Each of the bearing bushes 96 is integrally molded in one piece to the actuation lever 35 in the transition region between the two lever arms 61, 62 and the stop lug 63. Each of the bearing bushes 96 has a perimeter wall 98 or cylindrical surface 98, as well as a front wall 99. At the same time, in an upper region of the bearing bush 96 pointing to the actuation lever input arm 61, the interior surface 88 of the second L-shaped leg 81 is preferably merging in the cylindrical surface of the bearing bush 99 and the front wall of the bearing bush 99 is flush with the lateral edge 90 of the second L-shaped leg.

Furthermore, the support section 64 or the bearing bushes 96 comprise a preferably cylindrical actuation lever mounting recess 100, which is arranged centrally and vertically to the lateral surface of the actuation lever 68. The actuation lever mounting recess 100 extends from the front wall 99 of one bearing bush 96 through the actuation lever 35 directly to the front wall 99 of the opposite bearing bush 96. The actuation lever mounting recess 100 has the purpose of rotatably supporting the actuation lever 35, in particular on a actuation lever step arbor 101 (FIG. 8, 12), which is inserted in the actuation lever mounting recess 100 and in the first lug support recess 57*a, b* of the support lug 43*a, b* and preferably riveted in the lug support recess 57*a, b*. As a result, the actuation lever 35 is connected with the mounting plate 37, in particular the support lug 43*a, b* to be rotated about the actuation lever rotary axis 58.

The stop lug 63 has a first or upper stop lug wall 102, a second or bottom stop lug wall or stop surface 103 on the opposite side, as well as the two opposite stop lug lateral surfaces 67, which are arranged parallel to each other and vertically to the upper stop lug wall 102 and stop surface 103. At the same time, the upper stop lug wall 102 and the input arm perimeter wall 72 are merging in a rounded bent edge of the lug 104. Preferably, the upper stop lug wall 102 and the input arm perimeter wall 72 are arranged to each other at an obtuse angle. The upper stop lug wall 102 and the stop surface 103 are merging with each other via a vertically arranged stop lug front wall 105. In addition, the stop surface 103 is vertically integrally molded to or merging in a output arm front wall 106 of the actuation lever input arm 62.

Preferably, the actuation lever input arm 62 basically has a cube-shaped design and, as shown in the region of the bearing bush 96, it is integrally molded in one piece to the stop lug 63 and the actuation lever input arm 61. Furthermore, the actuation lever output arm 62 has a first, free output arm end 107 and a second output arm end, which faces the support section 64 and the actuation lever input arm 61. The actuation lever output arm 62 comprises the output arm front wall 106, which points in the direction of the stop lug 63 and which is vertically integrally molded to the stop surface 103, or the output arm surface 106 on the stop side, a output arm rear wall 108 arranged opposite of and parallel to the output arm surface 106. Furthermore, the actuation lever output arm 62 has the two output arm lateral surfaces 66, which extend vertically to the output arm front wall 106 and the output arm rear wall 108. Preferably, the output arm front wall 106 is merging at a right angle in the stop surface 103 or is integrally molded in one piece at a right angle to the stop surface 103, and preferably the output arm rear wall 108 is also merging basically at a right angle in the input arm bottom front wall 74 or is integrally molded in one piece with the input arm front wall 74. As an especially preferred feature, the stop surface 103 and the input arm bottom front wall 74 are on the same level or aligned to each other. Furthermore, at its free output arm end 107, the actuation lever output arm 62 has a output arm front wall 109, which is arranged vertically to the output arm front wall 106 and output arm rear wall 108, which output arm front wall 109 is adjacent to the output arm front wall 106 and extends toward the downtrust arm rear wall 108.

Furthermore, at its free output arm end 107, the actuation lever arm output arm 62 has a release element or actuating element 110 which, preferably, has a basically T-shaped design in cross section. Preferably, the actuating element 110 has a panel-type actuating bar 111 and a cube-shaped actuating lug 112 arranged vertically to the actuating bar 111.

Preferably, in an edge region of the output arm front wall 109 adjoining the output arm rear wall 108, the actuating bar 111 is vertically integrally molded to or merging in the output arm 62. The actuating bar 111 has a planar actuating bar interior surface 112, which is pointing in the same direction as the output front wall 106 and which is arranged vertically to the output front wall 109, an actuating bar exterior surface 114, which is arranged opposite of said actuating bar interior surface 112 and preferably merging in the output arm rear wall 108, two actuating bar lateral edges 115, which are preferably arranged vertically to the output arm front wall 109 and merging via chamfered and rounded corner edges in the actuating bar exterior surface 114, as well as an actuating bar trailing edge 116, which is arranged vertically to the actuating bar interior surface 113 and the actuating bar exterior surface 114. As a result, the actuating bar 111 basically represents an extension of the output arm rear wall 108 arranged vertically to the output arm front wall 109

Vertically, advantageously in the center, the actuating lug is integrally molded in one piece with the actuating bar interior surface 113, so that the actuating bar interior surface 113 comprises a first and second actuating surface 117 or is divide into the first and second actuating surface 117. The first and second actuating surface 117 serves the purpose of actuating or releasing the locking pawls 26.

Preferably, the actuating lug 112 has a cube-shaped design and comprises a lug top surface 118, which is pointing to the stop surface 103 and arranged vertically to the output arm front wall 106, a lug bottom surface 119, which is arranged opposite and parallel to the output arm front wall 106, two lug lateral walls 120, which are arranged vertically to the lug top surface and lug bottom surface 118, 119, to the two actuating surfaces 117 and to the output arm front wall 109, as well as a lug front wall 121, which is pointing in the same direction as the actuating surfaces 117, and which is arranged vertically to the lug top surfaces and the lug bottom surfaces 118, 118 and the lug lateral walls 120. As a result, the lug lateral surfaces 120 are merging at a right angle in the actuating surfaces 117, wherein the lug bottom surface 119 is advantageously flush with the actuating bar railing edge 116. Advantageously, with its lug top surface 118, the actuating lug 112 is also integrally molded in one piece, preferably in the center to the output arm front wall 109, wherein the lug lateral walls 120 are merging at a right angle in the output arm front wall 109. Preferably, the actuating lug 112 protrudes over the output arm front wall 106, wherein the lug top surface 118 merges via a rounded corner edge in the output arm front wall 106, so that the actuating lug 112 can engage in an intermediate area 122 (FIG. 13) between the actuating projection 34 of both locking pawls 26. The thickness of the lug 112, i.e., the extension of the lug front wall 121 between the two lug lateral walls 120, is smaller than to extension of the space 122 between the actuating projection 34.

The actuation lever 35 is arranged on the mounting plate 37 in such a way that it penetrates with the actuating element 110 the lever pass-through recess 36 of the mounting plate 37. At the same time, the actuation surfaces 117 of the actuation lever 35 face away from the first mounting recesses 48*a*, 48*b* and the second mounting recesses 49*a*, 49*b*. The actuation lever input arm 61 extends to the inside in relation to the mounting plate 37 and in non-actuated position of the actuation leverist 35 it is basically aligned vertically to the mounting plate 37, especially to the mounting leg 42*a*, 42*b*. In non-actuated position of the actuation lever 35, the actuation lever output arm 62 35 is also arranged basically vertically to the mounting plate 37, especially to the mounting legs 42*a*, 42*b*.

Figure 3:
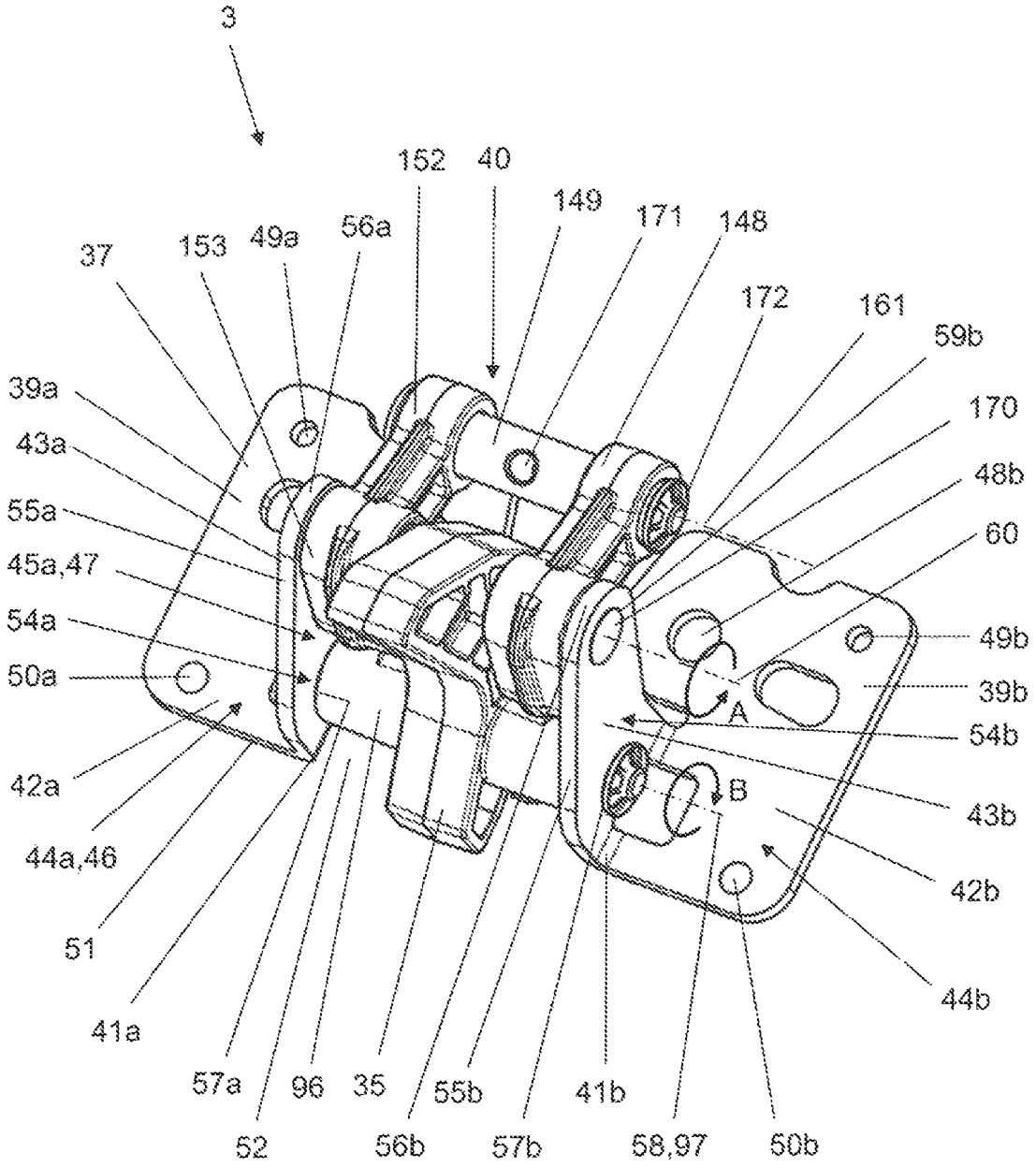
FIG. 3 is an isometric view of a bearing plate with driver lever and actuation lever of a release mechanism of the door lock shown in FIG. 1.

Furthermore, the actuation lever 35 is spring-loaded by means of the actuation lever spring 94, in particular a torsion spring, which tends to keep the actuation lever 35 in a non-actuated position, or drives the actuation lever 35 against actuating direction B (FIG. 3,4,5) about the actuation lever axis 58. For this purpose, the actuation lever spring 94 is advantageously supported with a contact tongue on the actuation lever 35, especially supported in the spring mounting slot 95, and with the other contact tongue on the interior surface of the longitudinal wall 10 of the lock case 6. To restrict the rotary motion of the actuation lever 35 against actuating direction B, the actuation lever 35 comprises the stop lug 63. In non-actuated position of the actuation lever 35 the stop lug 63 is adjoining the front wall 8 of the lock case 6, as a result of which the rotary motion of the actuation lever 35 against actuating direction B is blocked. Therefore, the lock case front wall 8 is used as an abutment for the rotary motion of the actuation lever 35 against actuating direction B.

The angular metal sheet 38 (FIG. 1, 7, 8, 9) comprises two leg plates arranged preferably at a right angle toward each other, which are connected with each other in a bent edge of the angular metal sheet 123. In particular, the leg plates are designed in the form of a preferably cube-shaped mounting plate 124, which is used to attach the angular metal sheet 38 on the lock case 6, especially by interconnecting the lever mounting plate 37, as well as in the form of a preferably prism-shaped bearing plate 125, which especially preferred has trapezoidal surfaces for attaching the remotely actuated release device 5 to the angular metal sheet 38. In addition, the angular metal sheet 38 has a reas side 126 and an opposite interior side 127.

The angular metal sheet mounting plate 124 comprises two continuous, cylindrical first mounting recesses 128*a*, 128*b*, which extend vertically to the mounting plate 124, and which are designed and arranged correspondingly to the first mounting recesses 48*a*, 48*b* of the lever mounting plate 37. In addition, the angular metal sheet mounting plate 124 comprises two continuous, cylindrical second mounting recesses 129*a*, 129*b*, which extend vertically to the mounting plate 124, and which are designed and arranged correspondingly to the second mounting recesses 49*a*, 49*b* of the lever mounting plate 37, as well as preferably two continuous, cylindrical third mounting recesses 130*a*, 130*b*, which extend vertically to the mounting plate 124, and which are designed and arranged correspondingly to the third mounting recesses 50*a*, 50*b* of the lever mounting plate 37.

Furthermore, the angular metal sheet mounting plate 124 preferably comprises a basically U-shaped lever pass-through recess 132, which extends from a frontal mounting plate longitudinal edge 131 arranged opposite of the angular metal sheet bent edge 123 into the mounting plate 124, which lever pass-through recess 132 preferably extends all the way into the bearing plate 125. The lever pass-through recess 132 runs basically in the center between the mounting recesses 128, 129, 130, in particular corresponding to the lever pass-through recess 52 of the lever mounting plate 37. At the same time, the lever pass-through recess 132 is dimensioned in such a way that it can be penetrated from the support lugs 43*a*, 43*b* of the lever mounting plate 37.

The bearing plate 125 comprises a continuous, preferably cylindrical mounting recess 133 or a remote-control release means mounting recess 133 for attaching a traverse tube 134 of the remotely-actuated release device 5, which is preferably positioned centrally in the edge region of a frontal bearing plate longitudinal edge 135 opposite to the angular metal sheet bent edge 123. In particular, the mounting recess 133 is arranged between a bottom edge of the lever pass-through recess 132 and the bearing plate longitudinal edge 135.

In the region of the angular metal sheet bent edge 123, on both sides of the pass-through recess 132, a reinforcement rib 136 is respectively provided on the interior side of the angular metal sheet and/or the exterior side of the angular metal sheet for reinforcing the angular metal sheet 38.

The angular metal sheet 38 is arranged in such a way that the longitudinal edge 135 of the bearing plate 125 is facing away from the lock case 6. At the same time, the angular metal sheet bent edge 123 is provided at the lock case longitudinal wall 11 on the side of the locking bolt and the mounting plate longitudinal edge 131 of the angular metal sheet at the continuous longitudinal wall 10 of the lock case.

Preferably, the locally actuable release device 4 comprises a push-button knob 137 (FIG. 1, 9), which basically comprises a locally actuable device mounting plate 138, a locally actuable release element, especially an actuating tappet 139 that can be moved in linear manner, as well as further locally actuable actuation means, for example, a push-button arranged in the push-button knob 137.

Advantageously, the locally actuable release device mounting plate 138 has a baseplate 140 with a preferably cylindrical tappet recess, as well as two clamping arms 141 preferably integrally molded at a right angle to the baseplate 140. Each of the clamping arms 141 has a first mounting recess 142 and preferably a second mounting recess 143. Preferably, the clamping arms 141 are designed in such a way that in mounted condition of the door lock 1 they extend on the exterior side of the support lug vertically toward the mounting plate longitudinal edge 131 in the direction of the angular metal sheet bent edge 123 adjacent to the interior side 127 of the angular metal sheet mounting plate 124. At the same time, the first mounting recesses 142 of the clamping arms 141 are aligned with the second mounting recesses 129*a*, 129*b* of the angular metal sheet 38. In the same way, the second mounting recesses 143 of the clamping arms 141 are aligned with the third mounting recesses 130*a*, 130*b* of the angular metal sheet 38.

Figure 1:
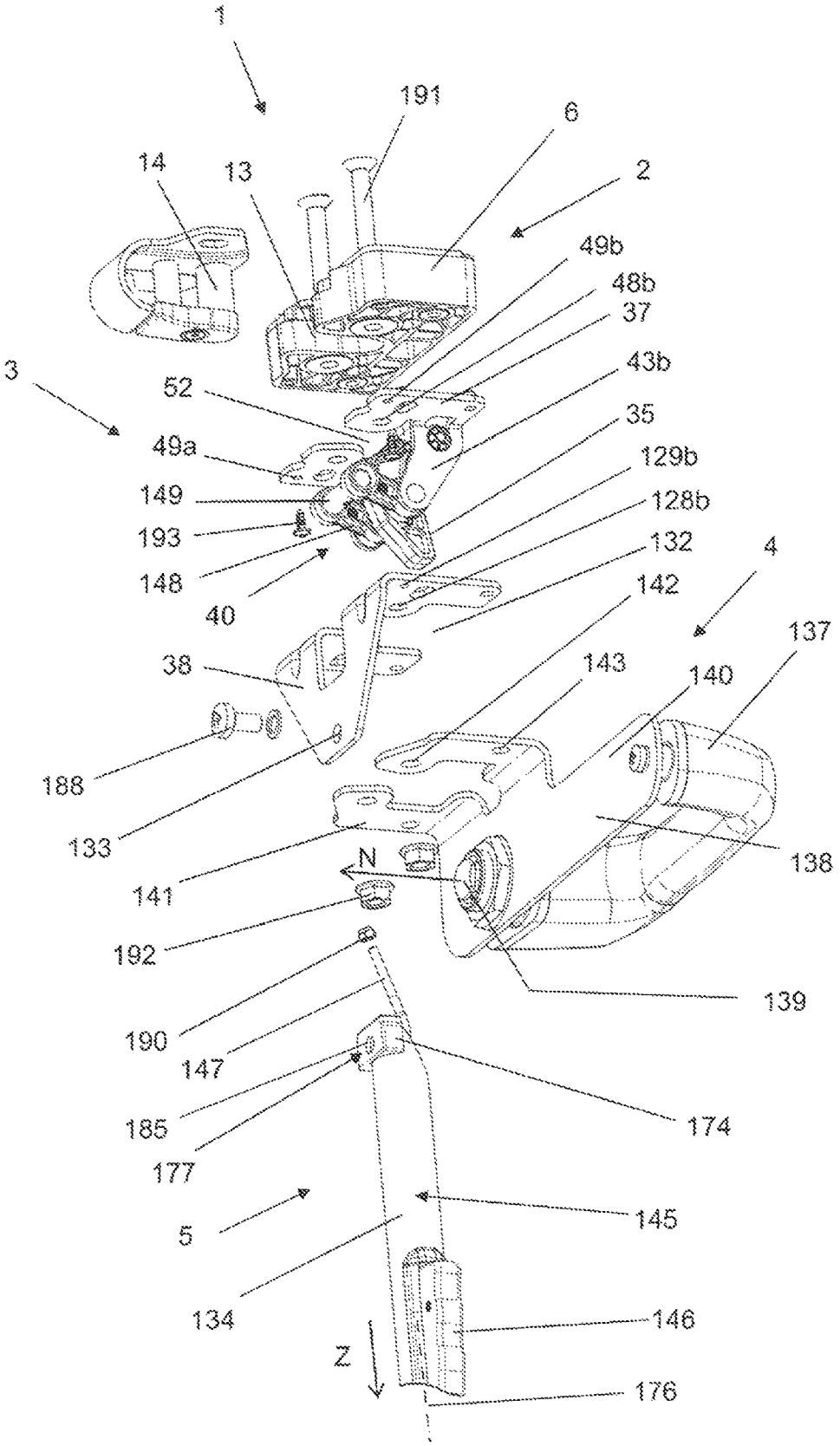
FIG. 1 is an isometric exploded view of a door lock embodying the principles of the present invention.
Figure 2:
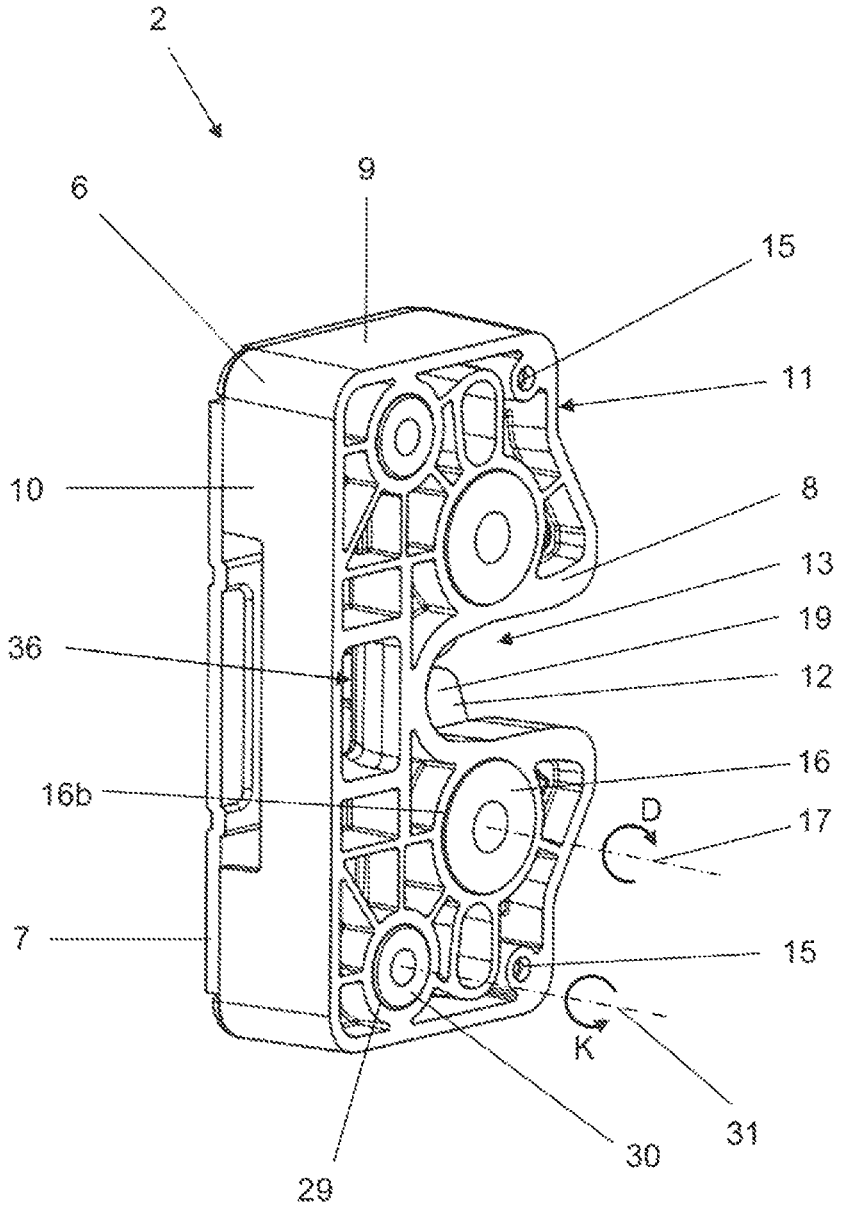
FIG. 2 is an isometric view of a lock case of the door lock.

The preferably cylindrical actuating tappet 139, which vertically penetrates the tappet recess in the direction of the baseplate 140, is arranged in the tappet recess. The actuating tappet 139 has a tappet perimeter wall, a first tappet end wall 144, which penetrates the tappet recess, as well as a second tappet end wall (not shown), which is arranged in the door handle 137 and which extends into the door handle 137. Advantageously, the actuating tappet 139 is arranged basically inside the door handle 137 and is mounted or guided in such a way that it can be moved back and forth. In addition, the actuating tappet 139 is spring-loaded by means of a tappet spring (not shown), which tends to keep the actuating tappet 139 in a non-actuated position, or which drives the actuating tappet 139 against the actuating direction N of the locally actuable release element (FIG. 1). Preferably, the first end wall 144 of the actuating tappet 139 is adjoining the driving surface 75 of the actuation lever 35, without at first actuating it.

As a result, especially via the actuating tappet 139 and the driving surface 75, the locally actuable release device 4 is in direct operative connection with the actuation lever 35 or can be brought in direct operative connection with the actuation lever 35, especially via the actuating tappet 139 and the driving surface 75.

The remotely actuable release device 5 (FIG. 1, 3, 6, 8) comprises the pivotable drive bracket 40, the traverse tube 134, a remote-control actuation button 146, which is mounted on the traverse tube 134 and is protruding over the tube shell 145 of the traverse tube 134 and can be pushed in, remote-control actuation means, which are arranged inside the traverse tube 134 and operatively connected with the remote-control actuation button 146, in particular a cable pull mechanism, and a remote-control actuation element or traction element 147, for example, a pulling cable (not shown) or a tension rod 147. At the same time, the tension rod 147 is operatively connected with the drive bracket 40, as well as with the remote-control actuation means.

The especially U-shaped drive bracket 40 comprises two pivoted drive levers 148, which are arranged in parallel to each other and which have preferably an L-shaped design, as well as a coupling rod 149, which is connected with the two drive levers 148. The drive bracket 40 is used for actuating or driving the actuation lever 35 over the respective extension strips 76, which is subsequently described in more detail.

Figure 6:
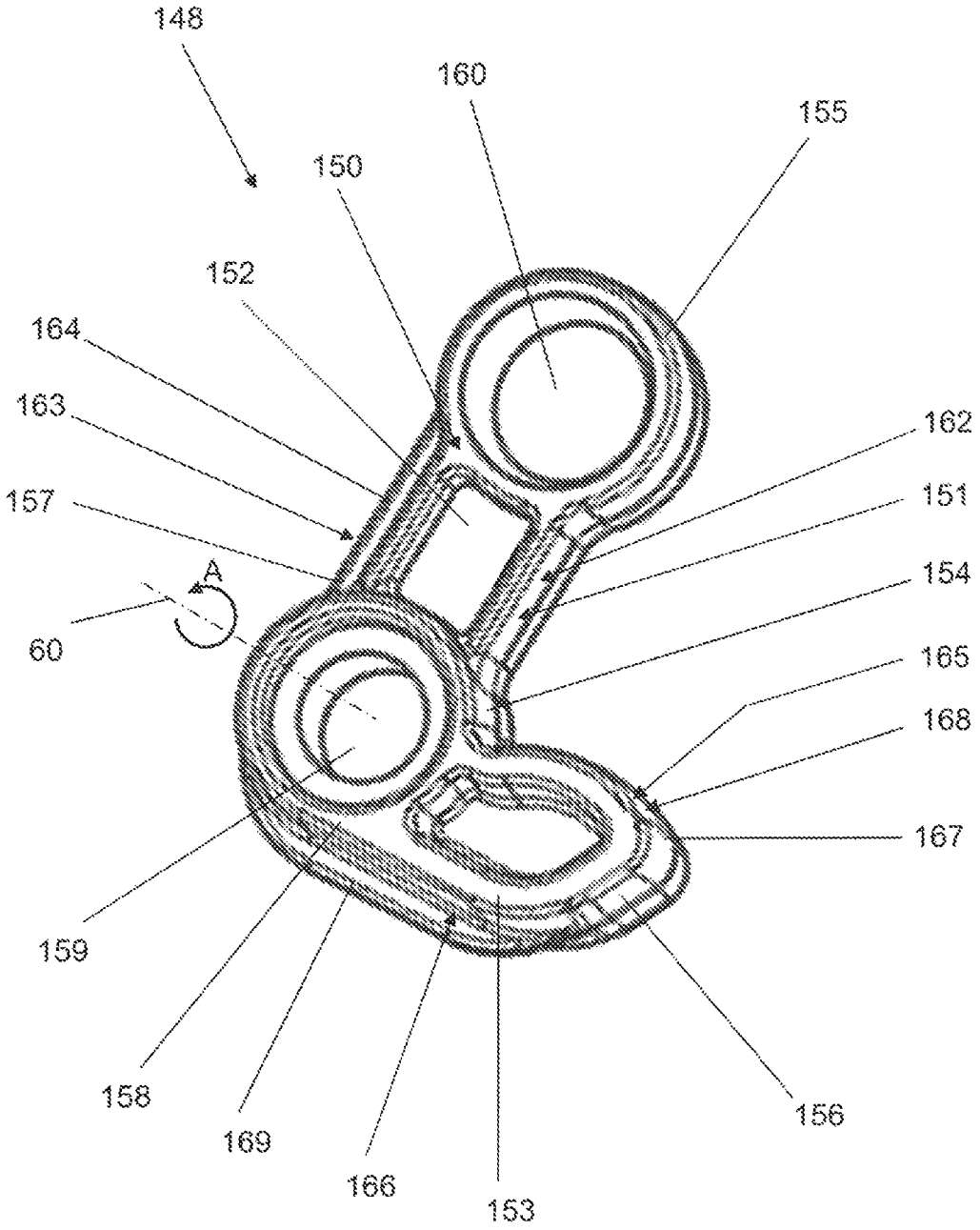
FIG. 6 is an isometric view of the drive lever shown in FIG. 3.
Figure 7:
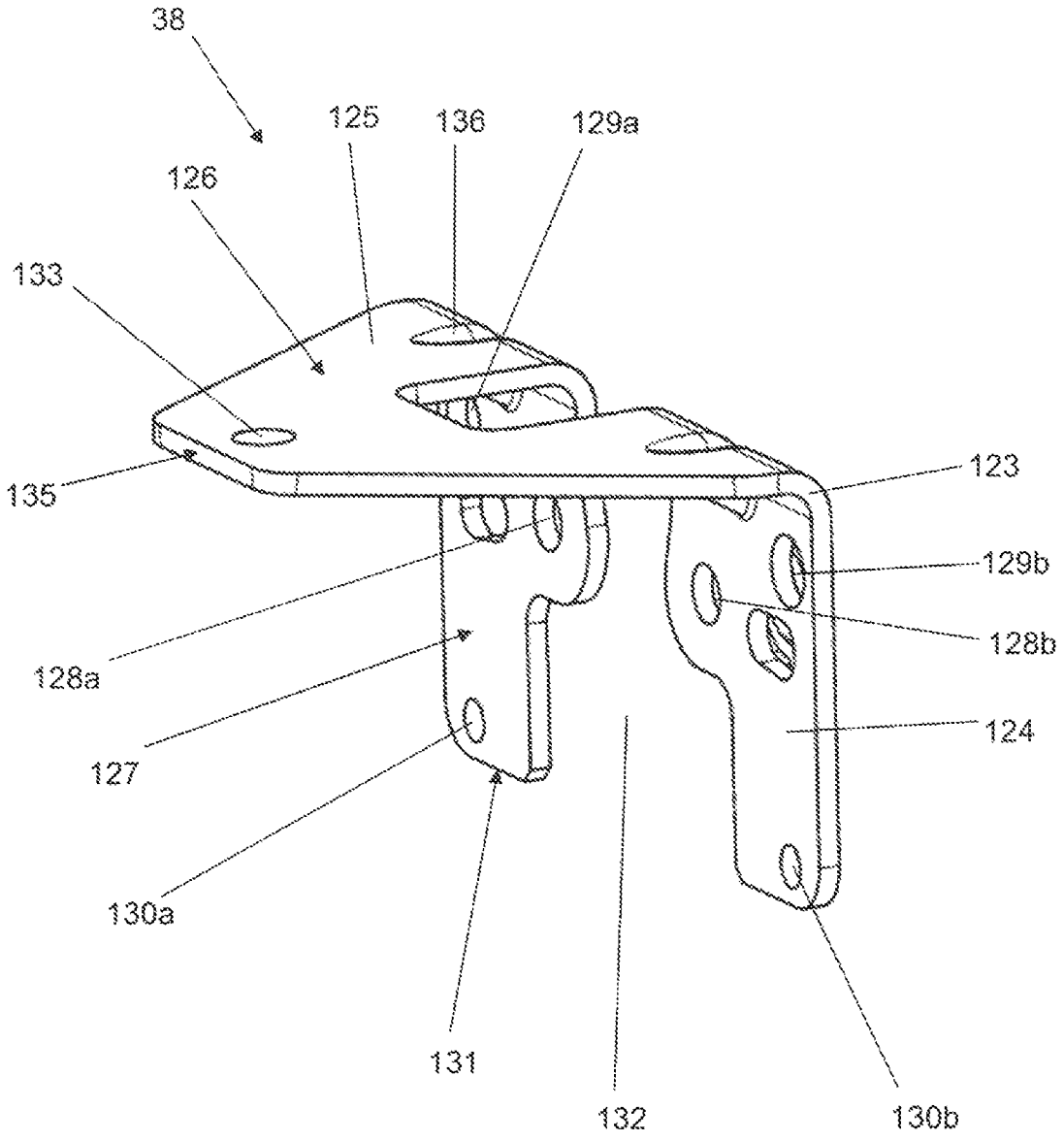
FIG. 7 is an isometric view of an angular metal sheet of the release mechanism of the door lock shown in FIG. 1.

The drive lever 148 (FIG. 6) comprises two parallel lateral surfaces 150 and a circumferential perimeter wall 151. Advantageously, the drive lever 148 comprises, respectively, also a first drive lever arm or drive arm 152 and a second drive lever arm or drive arm 153. In a transition region 154, the drive arm 152 and the drive arm 153 are merging into each other and are basically arranged at a right angle. As a result, the drive arm 152 and the drive arm 153 are having a free arm end 155, 156, which is facing away from the respectively other arm 152, 153 and an arm end 157, 158 which is facing the respectively other arm 152, 153. Furthermore, in the transition region 154 between the drive arm 152 and the drive arm 153, the drive lever 148 has an advantageously cylindrical mounting recess 159, which extends from the one lateral surface 150 to the opposite lateral surface 150 and which has an axis that is arranged vertically to the drive lever lateral surfaces 150. In addition, at the free drive arm end 155, the drive lever 148 has an advantageously cylindrical coupling rod recess 160, which extends from the one lateral surface 150 to the opposite lateral surface 150 for supporting the coupling rod 149 around a coupling rod axis 161. The coupling rod axis 161 is arranged vertically to the drive lever lateral surfaces 150.

The drive arm 152, in particular the region of the perimeter wall 151 on the side of the drive arm, has an interior wall 162 and an exterior wall 163. The drive arm interior wall 162 is facing the driven arm 153 and the exterior wall of the drive arm 163 is facing away from the driven arm 153. Advantageously, at the free end of the drive arm end 155, the interior wall of the drive arm 162 and the exterior wall of the drive arm 163 are merging into each other, wherein the free end of the drive arm 155 has a cylindrical design. Preferably, in the region of the cylindrical drive arm end 155, the drive lever perimeter wall 151 is protruding or bulging over the adjacent region of the drive lever perimeter wall 151. Preferably, a projection 164 is integrally molded on the drive arm exterior wall 163. The drive arm projection 164 is sticking out from the drive arm exterior wall 163 and is arranged centrally between the two drive arm lateral surfaces 150. In addition, the drive arm projection 164 extends between the bulged regions of the first and second drive arm ends 153, 155. The drive arm projection 164 is used for reinforcement.

The driven arm 153, in particular the region of the drive lever perimeter wall 151 on the side of the driven arm has an interior wall 165 and an exterior wall 166. The driven arm interior wall 165 is facing the drive arm 152 and the driven arm exterior wall 166 is facing away from the drive arm 155. At the same time, the driven arm interior wall 165 is merging via a rounded edge at a basically right angle into the drive arm interior wall 162 and the driven arm exterior wall 166 is merging via a rounded edge at a basically right angle into the drive arm exterior wall 163. Furthermore, at the free driven arm end 156, the driven arm interior wall 165 and the driven arm exterior wall 166 are merging into each other in a rounded end edge 167.

Furthermore, the driven arm interior wall 165 has a convex or arched design and represents an extension strip driving surface 168 with a preferably arched or convex progression, when viewed laterally.

Preferably, a driven arm projection 169 is integrally molded on driven arm exterior wall 166. The driven arm projection 169 is sticking out from the driven arm exterior wall 166 and is arranged centrally between the two drive lever lateral surfaces 150. In addition, the driven arm rojection 169 extends from the transition region 154 of the driven arm exterior wall 166 into the drive arm exterior wall 163 all the way to the driven arm end edge 167. The driven arm projection 169 is used for reinforcement.

The drive lever mounting recess 159 has the purpose of rotatably supporting the drive lever 148 about the drive lever rotary axis 60, especially on a step arbor 170. At the same time, one step arbor 170 is respectively inserted in the mounting recess 159 of the respective drive lever 148 and in the mounting recess 59 of the first and second support lug 43*a*, 43*b* of the mounting plate 37 and is attached to the respective drive lever mounting recesses 59, 159, in particular pressed or riveted in said mounting recesses. As a result, the two drive levers 148 can be respectively rotated about their rotary axis 60 and are rotatably connected with the mounting plate 37, especially the first support lug 43*a* or the second support lug 43*b*. As a result, both drive lever rotational axes 60 are arranged coaxially to each other and parallel to the actuation lever rotary axis 58, however not coaxially to the actuation lever rotary axis 58 but spaced from it.

In the coupling rod recess 160, the coupling rod 149 can be pivoted about the coupling rod axis 161. The coupling rod 149 has a cylindrical design and comprises a perimeter surface, a first and second coupling rod end, as well as one tension rod mounting recess 171, which is arranged in the perimeter surface preferably centrally between the two coupling rod ends. Advantageously, the tension rod mounting recess 171 extends through the perimeter surface of the coupling rod 149.

The first end of the coupling rod 149 is arranged in the coupling rod recess 160 of the first drive lever 148, and the second end of the coupling rod 149 is arranged in the coupling rod recess 160 of the second drive lever 148. At the same time, both drive levers 148 are adjacent and aligned to each other in a vertical direction in relation to drive lever lateral surfaces 150. The two driven arm end edges 167 point in the same direction. At the same time, the coupling rod 149 is immovably mounted in the coupling rod recesses 160, when viewed in the direction of the coupling rod axis 161, especially riveted or secured by means of an attached mounting disc 172.

Each of the two drive levers 148 is respectively arranged at the actuation lever lateral surfaces 68, i.e., between the actuation lever 35 and the support lug 43*a* or 43*b*, wherein in non-actuated position both drive arm ends 155 or the coupling rod 149 point in the direction of the bearing plate 125 and both driven arm end edges 167 point in the direction of the mounting plate 37 or are directed towards it. Furthermore, the extension strip driving surface 168 of the drive lever 148 is facing, especially adjacent to, the strip driving surface 85 of the actuation lever 35.

Furthermore, both drive levers 148 are advantageously spring-loaded via a remote-control release means spring (not shown), which affects the coupling rod 149, and thus both drive levers 148, via the tension rod 147 mounted in the tension rod recess 171. The remote-control release means spring tends to keep the drive lever 148 in a non-actuated position or the remote-control release means spring drives the drive lever 148 against a drive lever actuating direction A (FIG. 3, 4) about the drive lever rotary axis 60.

Furthermore, the drive lever actuating direction A is opposite to the actuation lever actuating direction B.

The drive levers 148 are in preferably direct operative connection with the actuation lever 35, in particular via the drive lever extension strip driving surfaces 168 and the actuation lever strip driving surfaces 85, or can be brought in preferably direct operative connection with the actuation lever 35, in particular via the drive lever extension strip driving surfaces 168 and the actuation lever strip driving surfaces 85.

By means of a box-shaped bearing block 174, the end (173) of the traverse tube 134 (FIG. 1, 8, 9, 10) arranged on the side of the angular metal sheet is preferably mounted at the inside of the bearing plate 125. For this purpose, the traverse tube 134 comprises at the end 173 arranged on the side of the angular metal sheet preferably an angular trailing end 175, to which a stop edge 173*a* is connected which extends vertically to a longitudinal edge 176 of the tube. Furthermore, the traverse tube 134 comprises a tube mounting recess, which extends on the side of the angular metal sheet and centrally in relation to the stop edge 173*a* of the tube.

Preferably, the bearing block 174 comprises a planar and rectangular exterior wall or mounting wall 177, two lateral walls 178, which extend vertically to the mounting wall 177 and are arranged opposite and parallel to each other, as well as two front walls 179, 180 arranged opposite of each other, which extend vertically to the lateral walls 178 and to the mounting wall 177. In mounted condition, the bearing block front wall 179 is facing away from mounting plate 124. For this condition, a traverse tube recess 181 with a semicircular cross section is provided, which has a bearing edge 182 that is facing away from the bearing block mounting wall 177. At the interior wall of the other bearing block front wall 180, a clamping bar 183 is arranged, which extends vertically to said front wall and in the direction of the opposite bearing block front wall 179, preferably all the way up to the opposite bearing block front wall 179, so that the bearing block 174 has an insertion slot 184 between the clamping bar 183 and the bearing block front wall 179, especially the bearing edge 182. The bearing block mounting wall 177 comprises a mounting hole 185, preferably in the center, which has a mounting hole axis 186 that is arranged vertically to the bearing block mounting wall 177. The clamping bar 183 comprises a mounting hole which is corresponding and aligned to the mounting hole 185 and which has a mounting hole axis 187. This means that the mounting hole axes 186, 187 are arranged coaxially to each other. Advantageously, the mounting hole 185 of the bearing block mounting wall 177 and/or the mounting hole of the clamping bar 183 have an internal thread.

With its end 173 on the side of the angular metal sheet, the traverse tube 134 is inserted in the insertion slot 184 of the bearing block 174 in such a way that the tube stop edge 173*a* attaches on the inside to the bearing block front wall 180 and the tube shell 145 rests in a form-fit manner on the outside against the bearing edge 182, wherein the inclined trailing edge 175 is facing away from the bearing plate 125. Furthermore, from the angular metal sheet rear side 126 through the remote-control release means mounting recess 133 of the angular metal sheet 38 and the tube mounting recess of the traverse tube 134, a tube retaining screw 188 is screwed into the mounting hole 185 of the bearing block mounting wall 177 and that of the clamping bar 183. This type of attachment makes it possible that in mounted condition the traverse tube 134 is unmovably or non-rotatably connected with bearing block 174 and bearing block 125 but, at the same time, the entire unit consisting of bearing block 174 and traverse tube 134 can be rotated about the mounting hole axis 186 before tightening the tube retaining screw 188, and thus its position can be variably fixed. As a result, the longitudinal axis of the tube 176 can be adjusted to the external conditions, i.e., to the respective vehicle dimensions.

The tension rod 147 is inserted into the traverse tube 134 from the angular metal sheet end 173 of the traverse tube 134 and protrudes with one end 189 over the stop edge 173*a* of the traverse tube 134, or protrudes out of the traverse tube 134. At its end 189, the tension rod 147 is connected with the coupling rod 149. Preferably, the tension rod end 189 has for this purpose an external thread region, which is guided through the tension rod mounting recess 171 of the coupling rod 149 and attached by means of a screw nut 190 on the side of the coupling rod 149 facing the mounting plate 124. In case of a pulling cable, it has a cable hook bent at a right angle, which is inserted in the tension rod mounting recess 171 (not shown).

As a result, the tension rod 147 extends vertically to the coupling rod 149 and is preferably in direct operative connection with the drive levers 148 via the coupling rod 149 or can be brought in direct operative connection with the drive levers 148 via the coupling rod 149. Furthermore, the tension rod 147 is in operative connection with the remote-control actuation means (not shown) and the remote-control actuation button 146 in such a way that a tractive force is applied to the tension rod 147, when an operator pushes the remote-control actuation button 146 inside the vehicle. This tractive force causes the tension rod 147, as well as the coupling rod 149, to move in a tension rod actuating direction Z (FIG. 8, 10), thus causing the drive levers 148 to rotate in drive lever actuating direction A. As a result, the drive levers 148 are connected with the tension rod 147 and can be driven in drive lever actuating direction A about the drive lever rotary axis 60.

The remote-control actuation means arranged in the traverse tube 134 are generally known and, as described, for example, in DE 199 52 012 A1, and can be positioned with variable limits in the traverse tube 134, preferably in tube axis direction 176.

At the end facing away from the angular metal sheet 38, the traverse tube 134 has a tube crimp (not shown) provided with an elongated hole, known, for example, from DE 199 52 012 A1, by means of which crimp the traverse tube 134 is screwed to frame struts of the vehicle door. Alternatively, the traverse tube 134 is attached at the frame struts, as described, for example, in DE 10 2005 016 253 A1.

When the rotary latch arrangement 2 and the release mechanism 3 (FIG. 9) are assembled, the mounting plate 37, the angular metal sheet mounting plate 124 and the clamping arms 141 of the door handle mounting plate 138 are mounted one after the other on the cover 8 of the lock case 6. At the same time, the rotary latch mounting bolts 16, the first mounting recesses 48*a*, 48*b* of the mounting plate 37, the first mounting recesses 128*a*, 128*b* of the angular metal sheet 38 and the first mounting recesses 142 of the door handle clamping arms 141 are aligned to each other in vertical direction to the mounting plate 37. In the same way, the drill holes 15 of the lock case 6, the second mounting recesses 49*a*, 49*b* of the mounting plate 37 and the second mounting recesses 129*a*, 129*b* of the angular metal sheet 38 are aligned to each other in vertical direction to the mounting plate 37. Correspondingly, also the third mounting recesses 50*a*, 50*b* of the mounting plate 37, the third mounting recesses 130*a*, 130*b* of the angular metal sheet 38 and the second mounting recesses 143 of the door handle clamping arms 141 are aligned to each other in vertical direction to the mounting plate 37. Furthermore, the lever pass-through recess 36 of the lock case cover 8, the lever pass-through recess 52 of the mounting plate 37 and the lever pass-through recess 132 of the angular metal sheet 38 are aligned to each other in a vertical direction to the mounting plate 37. Retaining screws 191 (FIG. 1) are inserted from the lock case baseplate 7 through the rotary latch bolts 16*b*, the first mounting recesses 48*a*, 48*b* of the mounting plate 37, the first mounting recesses 128*a*, 128*b* of the angular metal sheet 38 and the first mounting recesses 142 of the door handle clamping arms 141, and screw nuts 192 or mounting bushing are screwed on the retaining screws from the side of the clamping arm. In this way, the lock case 6, mounting plate 37, angular metal sheet 38 and door handle mounting plate 138 are firmly connected with each other. Furthermore, retaining screws 193 are inserted from the angular metal sheet 38 through the drill holes 15 of the lock case 6, the second mounting recesses 49*a*, 49*b* of the mounting plate 37 and the second mounting recesses 129*a*, 129*b* of the angular metal sheet 38. In this way, the lock case 6, the mounting plate 37 and the angular metal sheet 38 are also tightly screwed together. Preferably, retaining screws are also inserted from the door handle mounting plate 138 through the third mounting recesses 50*a*, 50*b* of the mounting plate 37, the third mounting recesses 130*a*, 130*b* of the angular metal sheet 38 and the second mounting recesses 143 of the door handle clamping arms 141. As a result, the lock case 6, the mounting plate 37, the angular metal sheet 38 and the door handle mounting plate 138 are also screwed together.

According to an alternative embodiment of the invention (not shown), the door lock has the above-mentioned rotary latch arrangement 2 and a release mechanism, which has the above-mentioned locally actuable release device 4 and the remotely actuable release device 5 with the actuation lever 35 and the drive bracket 40. Furthermore, the release mechanism comprises a mounting plate and an angular metal sheet, wherein these differ from the above-mentioned mounting plate 37 and angular metal sheet 38 in that the drive bracket 40 is mounted to the angular metal sheet instead of the mounting plate.

According to the alternative embodiment, the angular metal sheet comprises a first and second support lug for supporting the drive bracket 40 analogous to the above-mentioned mounting plate 37. Therefore, each of the angular metal sheet support lugs has the drive lever mounting recess 59*a*, 59*b*, in which the drive lever step arbor 170 is arranged for respectively supporting the drive lever 148.

According to the alternative embodiment, the mounting plate comprises a first and second support lug for supporting the actuation lever 35 analogous to the above-mentioned mounting plate 37. The first and second mounting plate support lug has, respectively, the actuation lever mounting recess 57*a*, 57*b*, in which the actuation lever step arbor 101 is arranged for supporting the actuation lever 35.

In assembled condition of the door lock according to the alternative embodiment, lock case 6, mounting plate, angular metal sheet and door lock 137 are preferably arranged analogous to the above-mentioned door lock 1.

The scope of the alternative embodiment of the invention involves that analogous to the above description the actuation lever is mounted to the angular metal sheet and the drive bracket is mounted to the mounting plate.

According to a further embodiment (FIG. 10) the door lock 1 has the above-mentioned rotary latch arrangement 2 and a release mechanism 194, which, as described above, has the locally actuable release device 4 and the remotely actuable release device 5 with the actuation lever 35 and the drive bracket 40. Furthermore, the release mechanism 194 has an angulat metal sheet 195, to which the actuation lever 35 and the drive bracket 40 are mounted.

Analogous to the above-mentioned angular metal sheet 38, the angular metal sheet 195 has a mounting plate 196 and a bearing plate 197, which merge in a bent edge into each other and in the process form the angular metal sheet rear surface 198, the angular metal sheet interior surface 199 and the lever pass-through recess 132.

Analogous to the above-mentioned mounting plate 37, the mounting plate 196 comprises a first and second support lug 43*a*, 43*b* for rotatably supporting the actuation lever 35 and for rotatably supporting the drive bracket 40. Furthermore, analogous to the above-mentioned angulat metal sheet 38, the mounting plate 196 comprises the first mounting recesses 128*a*, 128*b* and the second mounting recesses 129*a*, 129*b*, and preferably the third mounting recesses 130*a*, 130*b* for attaching the release mechanism 194 to the lock case 6. Therefore, the support lugs 43*a*, 43*b* comprise, repectively, the actuation lever mounting recess 57*a*, 57*b*, in which the step arbor 101 is arranged for supporting the actuation lever 35, and the drive lever mounting recess 59*a*, 59*b*, in which the drive lever step arbor 170 is arranged for supporting the drive lever 148. At the same time, the actuation lever 35 and the drive bracket 40 are arranged analogous to the release mechanism 3. In particular, the actuation lever is arranged in such a way that it penetrates with the actuating element 110 the lever pass-through recess 132 of the mounting plate 196 and the actuation surfaces 117 face away from the mounting plate 197.

Analogous to the above-mentioned angular metal sheet 38, the mounting plate 197 comprises the remote-control release means mounting recess 133 for attaching the remotely actuable release device 5, so that as described above the remotely actuable release device 5 is attached to the angular metal sheet 195 by means of the bearing block 174.

When the rotary latch arrangement 2 and the release mechanism 194 are assembled, the mounting plate 196 and the door handle mounting plate 138 are mounted one after the other on the cover 8 of the lock case 6. At the same time, the rotary latch mounting bolts 16, the first mounting recesses 128*a*, 128*b* of the angular metal sheet 195 and the first mounting recesses 142 of the door handle clamping arms 141 are aligned to each other in vertical direction of the mounting plate 196 and, as described above, penetrated by the retaining screws 191. In the same way, the drill holes 15 of the lock case 6 and the second mounting recesses 129*a*, 129*b* of the angular metal sheet 195 are aligned to each other in vertical direction of the mounting plate 196 and penetrated by the retaining screws 193.

Figure 10:
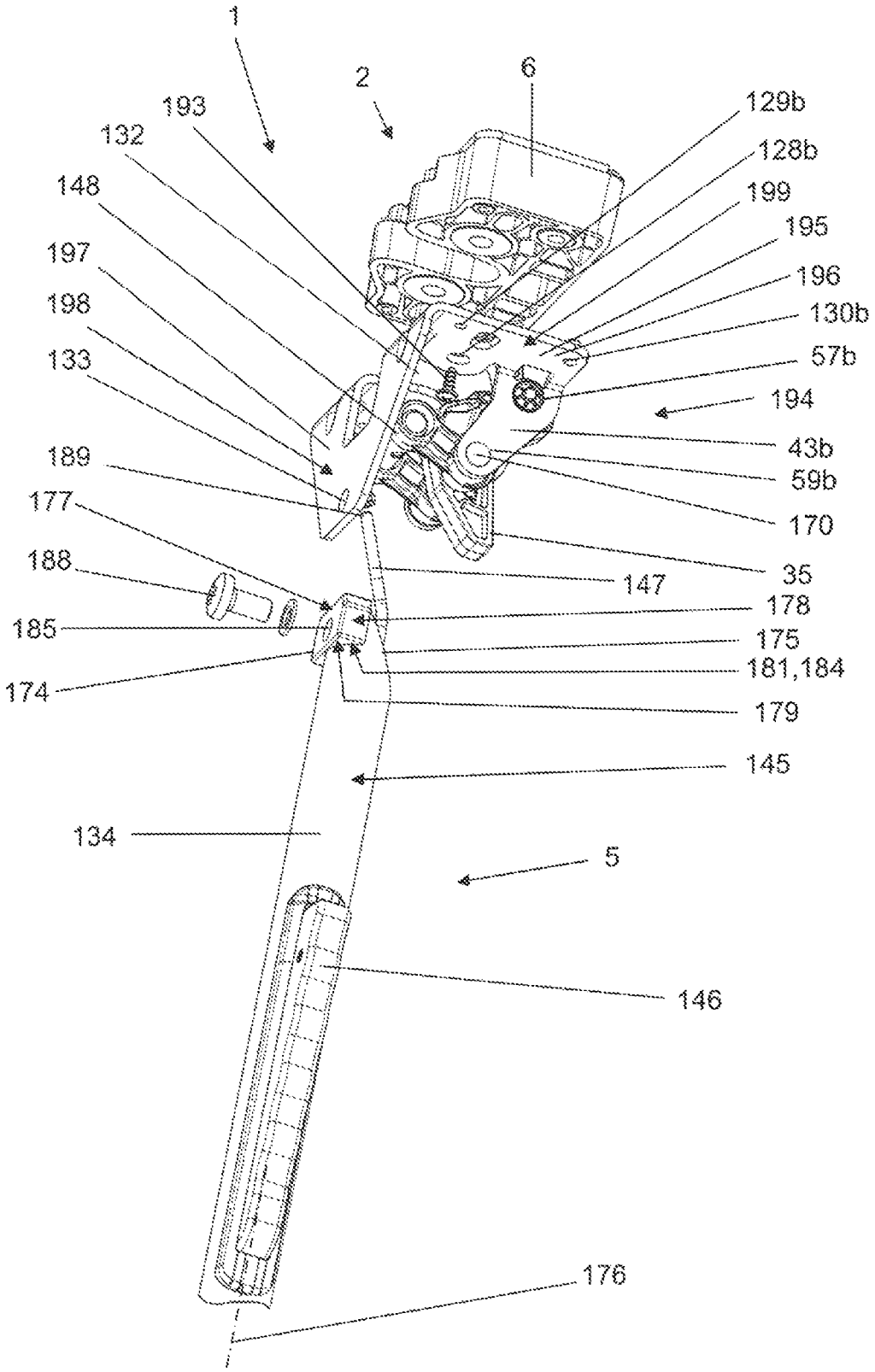
FIG. 10 is an isometric exploded view of a door lock according to a further embodiment.
Figure 11:
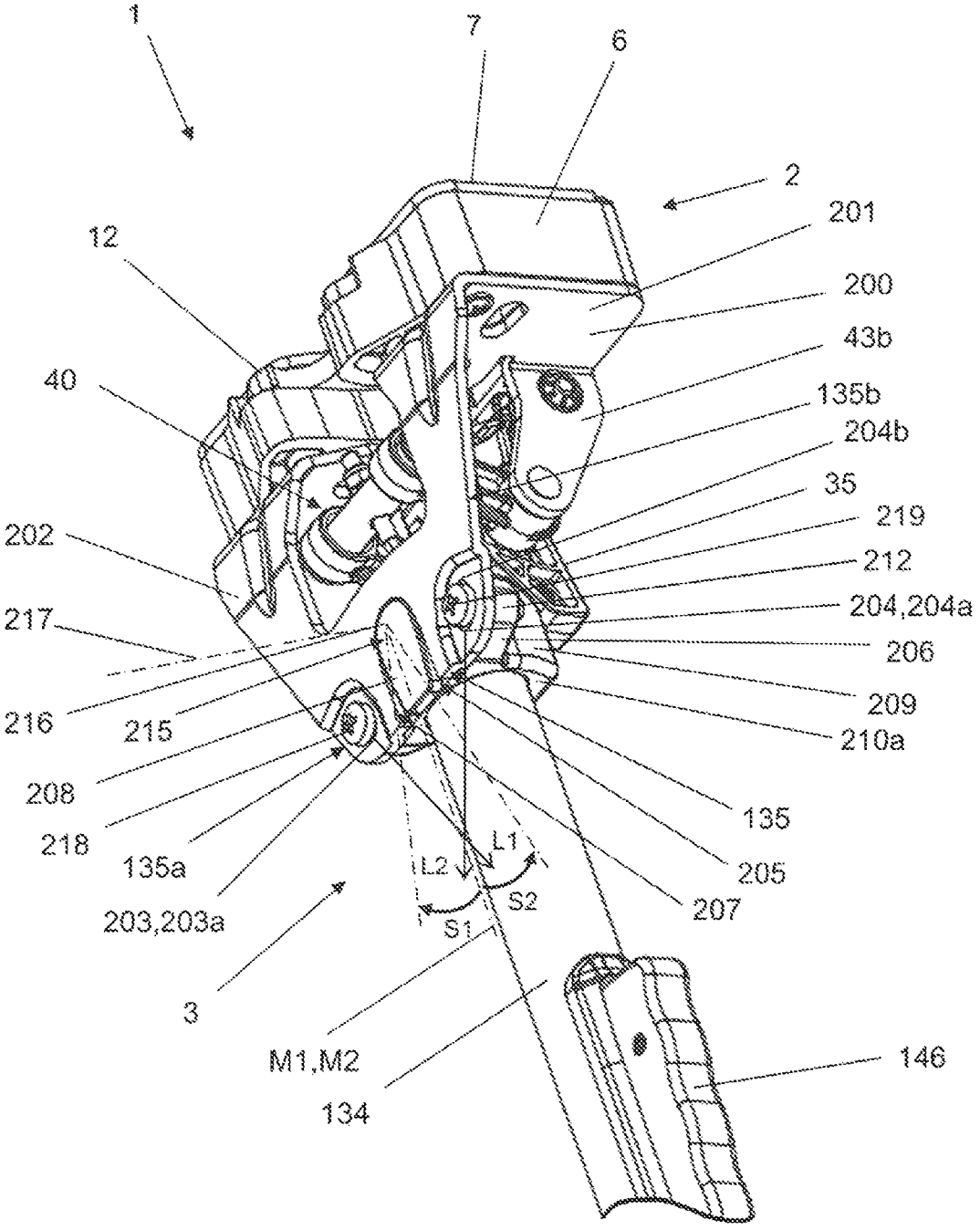
FIG. 11 is an isometric view of the door lock shown in FIG. 10 in mounted condition with an angular metal sheet according to an advantageous embodiment.
Figure 12:
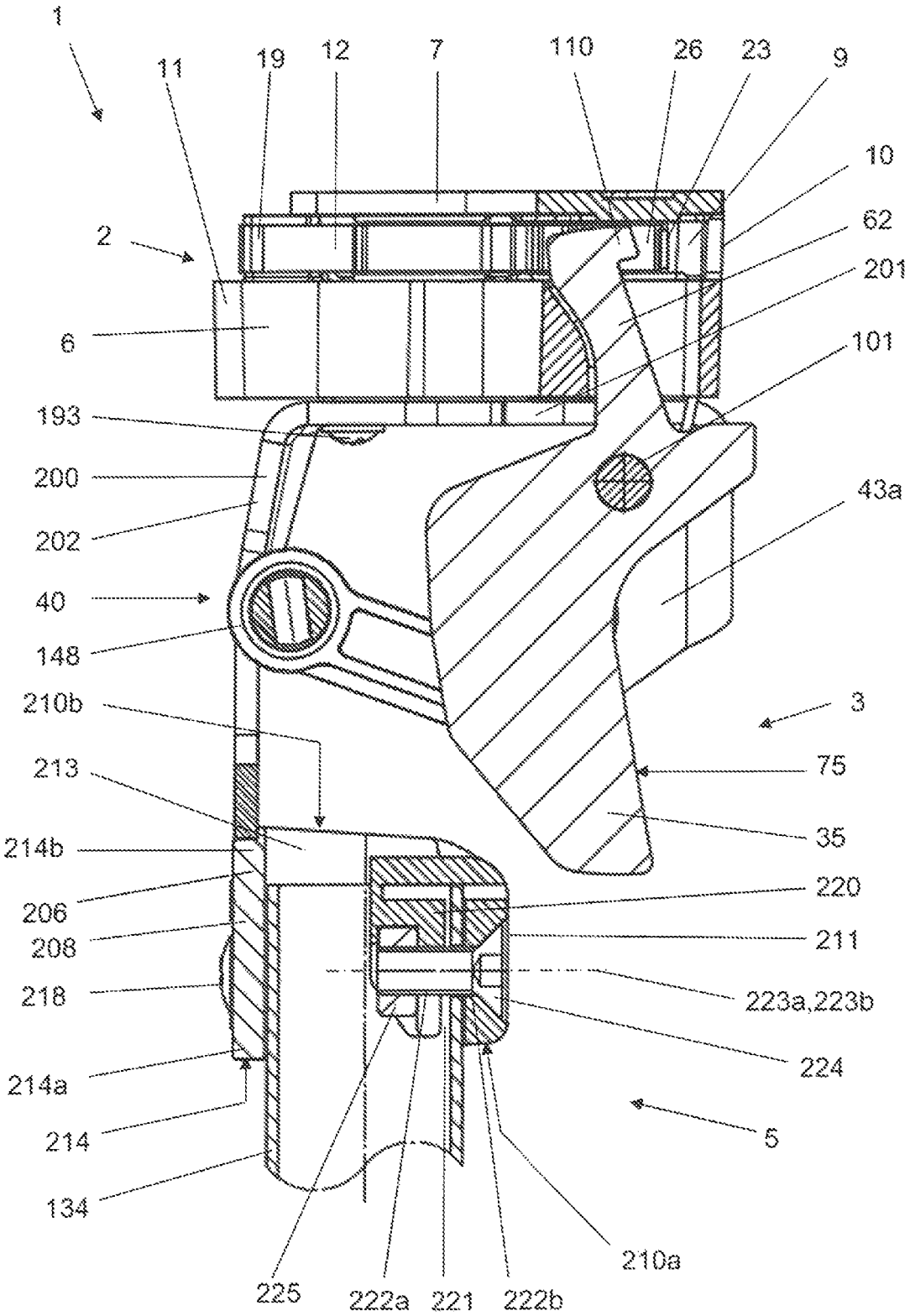
FIG. 12 is a sectional lateral view of the door lock shown in FIG. 11 (with open rotary latches)

According to an advantageous embodiment of the invention (FIG. 11, 12), which is subsequently described in an exemplary manner by means of the embodiment shown in FIG. 10, the door lock 1 comprises an angular metal sheet 200 with a mounting plate 201 and a bearing plate 202, in which two longitudinal remote-control release means mounting recesses 203, 204 are provided instead of the one remote-control release means 133 (FIG. 6) arranged centrally in the end region of the bearing plate. Furthermore, the bearing plate 202 comprises a lug recess 205. In addition, instead of the bearing block 174 (FIG. 1), a pivotable bearing element 206 is provided for attaching the traverse tube 134 to the bearing plate 202.

Preferably, the first mounting recess 203 is arranged in a corner segment between the bearing plate lateral edge 135 and a first bearing plate lateral edge 135*a* and is particularly designed in the form of an elongated hole 203 with a first end 203*a* facing the bearing plate lateral edge 135 and a second end 203*b* facing away from the bearing plate lateral edge 135. At the same time, the first mounting recess 203 comprises a longitudinal axis L1 in the direction of the bearing plate longitudinal edge 135, so that an imaginary extension of the first mounting recess 203 intersects a center line M1 of the bearing plate 202, in particular at a 22.5° angle.

Preferably, the second mounting recess 204 is arranged in the other corner segment between the bearing plate longitudinal edge 135 and a second bearing plate lateral edge 135*b* and is also designed in the form of a longitudinal hole 204 with a first end 204*a* facing the bearing plate lateral edge 135 and a second end 204*b* facing away from the bearing plate lateral edge 135. At the same time, the second mounting recess 204 has a longitudinal axis L2 in the direction of the bearing plate longitudinal edge 135, so that an imaginary extension of the second remote-control release means mounting recess 204 intersects the center line M1 of the bearing plate 202, in particular at a 22.5° angle.

Preferably, the first and second remote-control release means mounting recess 203, 204 are arranged toward each other in such a way that their imaginary extensions include 45° angle. Especially preferred, the center line M1 of the bearing plate 202 represents a symmetrically identical axis for the remote-control release means mounting recesses 203, 204, so that their first ends 203*a*, 204*a* and second end 203*b*, 204*b* repectively have the same distance to the center line M1.

The lug recess 205 extends in the bearing plate 202 in a linear manner and centrally, i.e., along the center line M1, from the longitudinal edge 135 in the direction of the lever pass-through recess 132 through the bearing plate 202. The lug recess 205 has a lug recess wall 207. At the end facing the lug recess 132, the lug recess wall 207 is preferably rounded, especially in semi-circular manner The lug recess 205 has the purpose of receiving the lug 208 of the bearing element 206.

Preferably, the bearing element 206 is shaped in the form of an anvil and has a planar and especially rectangular upper side or mounting wall (not shown), two lateral walls 209, which are arranged opposite of each other and vertically to the mounting wall, two front walls 210*a*, 210*b*, which are arranged opposite to each other and vertically to the lateral walls 209 and the mounting wall, and a bottom side 211, which is arranged opposite of, and preferably parallel to, the mounting wall. Furthermore, the bearing element 206 comprises two mounting lugs 212, which respectively stick out from the lateral wall 209 and which are arranged coplanar to the mounting wall, with each mounting lug having an angular metal sheet mounting hole (not shown). Furthermore, the bearing element 206 comprises the lug 208 and a recess 213 formed in the first front wall 210*a* and passing through the bearing element 206, to be able to insert the traverse tube 134.

Preferably, the lug 208 extends vertically from the mounting wall and has a perimeter wall 214 with a first end 214*a* and a second end 214*b*, as well as a preferably planar upper side 215. The lug extends centrally 208, i.e., along a center line M2 of the bearing element 206, with the first end 214*a* extending from the first front wall 210*a* in the direction of the second front wall 210*b*. At the first end 214*a* facing the first front wall 210*a*, the perimeter wall 214 is preferably leveled, so that the first end 214*a* is arranged coplanar with the first front wall 210*a*. At the second end which is facing the second front wall 210*b*, the perimeter wall 214 is rounded.

The lug 208 can be inserted in the lug recess 205 of the bearing plate 202, wherein in assembled condition the second end 214*b* is preferably adjacent to the lug recess wall 207. The first end 214*a* and a region adjoining the first end 214*a* are spaced from the lug recess wall 207, so that the lug 208 can be pivoted back and forth by a limited amount inside the lug recess 205. At the same time, the lug 208 can be pivoted at a pivot point 216 through a rotary axis 217 with a pivot angle S1, S2, which rotary axis extends through the pivot point 216 and vertically to the center line M2. Preferably, the pivot angle S1, S2 ranges between 7° and 7.5°. By means of two screws 218, 219, which respectively penetrate the first or second mounting recess 203, 204 and the angular metal sheet mounting hole of the bearing element 206, which respectively corresponds to said mounting recess, and two locking nuts screwed to the bearing element 206, the bearing element 206 can be fixed in the desired pivoted position.

In the traverse tube recess 213, which in mounted condition is facing away from the mounting plate 201, a clamping bar 220 is arranged at the interior wall of the element bottom side 211, and said clamping bar 220 extends from the first front wall 210*a* in the direction of, and preferably all the way up to, the opposite front wall 210*b*. The clamping bar 220 is designed analogous to the above-mentioned clamping bar 183 of the bearing block 174, so that an insertion slot 221 is available between the clamping bar 220 and the first front wall 210*a*. The element bottom side 211 and the clamping bar 220 have a drill hole 222*a*, 222*b*, the mounting hole axes 223*a*, 223*b* of which are arranged coaxially and vertically to the element bottom side 211. The traverse tube 134 inserted in the insertion slot 221 is attached with a tube retaining screw 224 and a locking nut 225, which penetrates from the element bottom side 211 the drill holes 222*a*, 222*b* and the traverse tube drill hole.

This type of attachment makes it possible that in mounted condition the traverse tube 134 is unmovably or non-rotatably connected with the bearing element 206. However, before tightening the retaining screws 218, 219, the entire unit consisting of bearing element 206 and traverse tube 134 can be rotated about the rotary axis 217 with the pivot angle S1, S2, and thus its position can be variably fixed. As a result, the alignment of the traverse tube axis 176 can be adjusted to the external conditions, i.e., to the respective vehicle dimensions.

The scope of the invention involves that the bearing element 206 has any other appropriate form, for example, a rectangular shape.

Subsequently, the function of the invention-based door lock 1 is described in more detail:

In closed position of the rotary latch arrangement 2 and non-actuated position of the release mechanism 3 (FIG. 13*a*), the locking lugs 19 of the rotary latches 12 are facing each other and the locking bolt 14 is arranged in a form-fit manner in the grooves 20 of the rotary latches 12 and tightly encompassed by them. The two locking pawls 26 prevent the two rotary latches 12 from being turned back into opened position through the force of the rotary latch springs 21. Through the force of the pawl springs 33, said locking pawls 26 are pushed with their latches 32 against the toothing arrangement 23 of the rotary latches 12 and in the process they are engaging in the toothing arrangement 23, thus locking the rotary latches 12.

Furthermore, the actuating tappet 139 of the door handle 137 is attached with its tappet end wall 144 at the driving surface 75 of the actuation lever 35, without actuating it, and the two drive levers 148 are respectively attached with extension strip driving surface 168 at the strip driving surface 85 of the respective extension strip 76, without actuating them.

Through the lever pass-through recess 36 in the lock case cover 8, the actuation lever 35 engages with its actuating element 110 in the lock case 6. At the same time, the actuation surfaces 117 of the actuating bar 111 are preferably attached to the actuating projections 34 of the locking pawls 26, without cutting them. At the same time, the actuating lug 112 is arranged in the intermediate space 122 between the actuating projections 34.

The opening or unlatching of the rotary latch arrangement 2 can then occur selectively by means of the locally actuable release device 4, thus the door handle 137, or by means of the remotely actuable release device 5, thus with the cable pull mechanism in the traverse tube 134.

To open the rotary latch arrangement 2 by means of the remotely actuable release device 5, the remote-control actuation button 146 is pushed, starting from the vehicle interior, by a user, into the tube interior of the traverse tube 134. As a result, a tractive force is generated on the tension rod 147 by means of the remote actuation means in the direction Z, which causes the two drive levers 148 to be pivoted in the drive lever actuation direction A by means of the coupling rod 149. The drive levers 148 press against the strip drive surfaces 85 of the respective extension strips 76 of the actuation lever 35 with their respective extension strip drive surfaces 168 as a result. The torque generated thereby causes, in turn, the actuation lever 35 to be pivoted in the actuation lever actuation direction B, which in turn, applies a force, on its part, to the actuating projection 34 of the locking pawl 26 by means of the actuation element 110, via the actuation surfaces 117, which is pivoted as a result, against the force of the pawl spring 33, in the pawl actuation direction K. The locking pawl latches 32 are moved out of the toothing arrangement 23 of the rotary latches 12, whereby the rotary latches 12 are released. The rotary latches 12 snap into their open position, driven by the force of the rotary latch springs 21. The locking bolt 214 is pushed by the walls of the grooves 20 out of the lock case 6 (FIG. 13*b*).

After releasing the remote-control actuation button 146, it is automatically pushed back to its starting position from the traverse tube 134 by a spring mechanism (not shown). As a result, a pressure is applied to the tension rod 147 counter to the tension rod actuation direction Z, and the drive levers 148 are likewise pivoted back to their starting position, counter to the drive lever actuation direction A. The drive levers 148 no longer push against the extension strips 76 of the actuation lever 35. At this point, the actuation lever 35 snaps back into its starting position, driven by the force of the actuation lever spring 94. The actuation lever 35 drives the drive lever 148, in addition to the tension rod, counter to the drive lever actuation direction A. The locking pawls 26 are again released, and rotate, driven by the force of the pawl springs 33, counter to the pawl actuation direction K, until they bear against the perimeter walls 22 of the rotary latches 12 with the locking pawl latches 32 (FIG. 13*c*).

When opening the door lock 1 by means of the locally actuatable release device 4, the actuation lever 35 is pivoted by means of the actuating tappet 139 of the door handle 137. For this, a pressure is applied to the actuating tappet 139 in the actuation direction N of the locally actuable release element by pushing the push button on the door handle 137 on the outside of the vehicle. The actuating tappet 139 pushes on the drive surface 75 of the actuation lever 35 with its tappet end wall 144 as a result. This causes, in turn, the actuation lever 35 to be pivoted in the actuation lever actuation direction B, and the locking pawls 26 are actuated, as described above, whereby the rotary latches 12 are released (FIG. 13*b*).

When the push button is released, pressure is no longer applied to the actuating tappet 139 and the actuating tappet 139 is driven back into its starting position by the force of a spring (not shown) against the actuation direction N of the locally actuable release element. The actuation lever 35 and the locking pawls 26 likewise snap back into their starting positions, as described above (FIG. 13*c*).

When the vehicle door is closed, the locking bolt 14 again ends up in the region of the grooves 20 of the rotary latches 12. These are pivoted by the pressure of the locking bolt 14 on the rotary latches 12, against the pressure of the rotary latch springs 21, counter to the rotary latch opening direction D. As a result of the rotational movement, the locking lugs 19 end up behind the locking bolt 14, and encompass it. As a result of the pivoting of the rotary latches 12, the toothing arrangement 23 ends up in the region of the locking lugs 24 of the locking pawls 26, wherein, due to the pressure of the pawl springs 33, the locking lugs 24 in the toothing arrangement 23 first snap in place in the latching recess 25, for the safety latching, or preliminary latching, and then, when the rotary latches 112 are rotated further, for the completely closed position of the rotary latch arrangement 2, behind the second rotary latch locking lug 24, seen in the opening direction D of the rotary latch.

The advantage of the door lock according to the invention is, first of all, that it is very robust and functionally reliable. Due to the symmetrical drive lever, disposed on both sides of the actuation lever, an easier releasing of the rotary latches is also obtained. The door handle is thus easier to open, or, respectively, less force is required to open the door handle. Furthermore, due to the symmetrically designed drive lever device, a simple installation of the door lock is ensured. Furthermore, only one engagement recess is needed in the lock case, because both the locally actuatable release device, as well as the remotely actuatable release device, act on the locking pawl via the same actuating lever.

Furthermore, the release mechanism according to the invention can also be used for door locks, the rotary latch arrangements of which have only one rotary latch and one locking pawl locking the rotary latch, or the rotary latch arrangements of which have two rotary latches, but only one locking pawl, which locks both rotary latches. The traverse tube can also have a variety of designs, and one or more bends, when a pull cable is used.

I hereby claim:

1. A vehicle door lock for locking and closing doors of motor vehicles, the vehicle door lock comprising:

a rotary latch arrangement having a lock case including a recess for a locking bolt, a pivoted rotary latch arranged in the lock case and configured to encompass and alternately retain the locking bolt in a pre-locked position and a final locked position, a pivoted locking pawl arranged in the lock case and configured to alternately lock the rotary latch in its pre-locked position and its final locked position, and a release mechanism configured to unlock the rotary latch, the release mechanism having a first release device with a traverse tube, a cable pull mechanism including a traction element led through the traverse tube, an actuator configured to actuate the cable pull mechanism, a pivoted actuation lever engaging in the lock case and having two opposite actuation lever lateral surfaces, the actuation lever being rotatably connected with the first release device in an actuation lever actuating direction to be driven about an actuation lever rotary axis, wherein the locking pawl is actuated by rotating the actuation lever in the actuation lever actuating direction in such a way that the locking mechanism of the rotary latch can be released, wherein the actuation lever further includes two drive elements which respectively extend out from one of the two actuation lever lateral surfaces and which respectively have one driving surface, the first release device having a U-shaped drive bracket with two pivoted drive levers and a coupling rod, which is connected with the traction element, wherein the drive levers are on one end connected with each other by means of the coupling rod and on the other end slidably abut against one of the two driving surfaces respectively, the actuation lever being rotatably connected with the traction element via the drive bracket to be driven in the actuation lever actuating direction, and the drive levers are each pivotable about a drive lever rotating axis, wherein both of the drive lever rotating axes are arranged coaxially to each other and parallel to the actuation lever rotating axis but not coaxially to the to the actuation lever rotating axis.

2. The vehicle door lock according to claim 1, wherein the drive bracket is arranged outside of the lock case.

3. The vehicle door lock according to claim 1, wherein the actuator has an actuation button pivotably connected with the traverse tube in such a way that upon actuation the actuation button it is moveable in the traverse tube.

4. The vehicle door lock according to claim 3, wherein the traction element is connected with the actuation button and can be driven in a traction element actuating direction, wherein the drive levers can be rotated in a drive lever actuating direction by moving the traction element in traction element actuating direction.

5. The vehicle door lock according to claim 1, wherein the actuation lever is rotatably connected via the driving surfaces with the two drive levers to be driven in the actuation lever actuating direction.

6. A vehicle door lock for locking and closing doors of motor vehicles, the vehicle door lock comprising:

a rotary latch arrangement having a lock case including a recess for a locking bolt, a pivoted rotary latch arranged in the lock case and configured to encompass and alternately retain the locking bolt in a pre-locked position and a final locked position, a pivoted locking pawl arranged in the lock case and configured to alternately lock the rotary latch in its pre-locked position and its final locked position, and a release mechanism configured to unlock the rotary latch, the release mechanism having a first release device with a traverse tube, a cable pull mechanism including a traction element led through the traverse tube, an actuator configured to actuate the cable pull mechanism, a pivoted actuation lever engaging in the lock case and having two opposite actuation lever lateral surfaces, the actuation lever being rotatably connected with the first release device in an actuation lever actuating direction to be driven about an actuation lever rotary axis, wherein the locking pawl is actuated by rotating the actuation lever in the actuation lever actuating direction in such a way that the locking mechanism of the rotary latch can be released, wherein the actuation lever further includes two drive elements which respectively extend out from one of the two actuation lever lateral surfaces and which respectively have one driving surface, the first release device having a U-shaped drive bracket with two pivoted drive levers and a coupling rod, which is connected with the traction element, wherein the drive levers are on one end connected with each other by means of the coupling rod and on the other end slidably abut against one of the two driving surfaces respectively, the actuation lever being rotatably connected with the traction element via the drive bracket to be driven in the actuation lever actuating direction, and the release mechanism including a second release device with a push-button located outside of the vehicle, an actuating element configured to actuate the actuation lever, and the actuating element being coupled to and driven by the push-button.

7. The vehicle door lock according to claim 6, wherein the actuating element includes an linearly moveable actuating tappet that is connected with the push-button to be driven in the actuating direction.

8. The vehicle door lock according to claim 1, wherein the actuation lever is connected with an actuation lever spring and configured to be driven about the actuation lever rotary axis against the actuation lever actuating direction.

9. The vehicle door lock according to claim 1, wherein the actuation lever is formed symmetrically in relation to a transverse central plane of the lock case.

10. A vehicle door lock for locking and closing doors of motor vehicles, the vehicle door lock comprising:

a rotary latch arrangement having a lock case including a recess for a locking bolt, a pivoted rotary latch arranged in the lock case and configured to encompass and alternately retain the locking bolt in a pre-locked position and a final locked position, a pivoted locking pawl arranged in the lock case and configured to alternately lock the rotary latch in its pre-locked position and its final locked position, and a release mechanism configured to unlock the rotary latch, the release mechanism having a first release device with a traverse tube, a cable pull mechanism including a traction element led through the traverse tube, an actuator configured to actuate the cable pull mechanism, a pivoted actuation lever engaging in the lock case and having two opposite actuation lever lateral surfaces, the actuation lever being rotatably connected with the first release device in an actuation lever actuating direction to be driven about an actuation lever rotary axis, wherein the locking pawl is actuated by rotating the actuation lever in the actuation lever actuating direction in such a way that the locking mechanism of the rotary latch can be released, wherein the actuation lever further includes two drive elements which respectively extend out from one of the two actuation lever lateral surfaces and which respectively have one driving surface, the first release device having a U-shaped drive bracket with two pivoted drive levers and a coupling rod, which is connected with the traction element, wherein the drive levers are on one end connected with each other by means of the coupling rod and on the other end slidably abut against one of the two driving surfaces respectively, and the actuation lever being rotatably connected with the traction element via the drive bracket to be driven in the actuation lever actuating direction, the actuation lever also including an actuation lever input arm, an actuation lever output arm, and a stop lug arranged in the transition region of the actuation lever input arm and actuation lever output arm.

11. A vehicle door lock according to claim 10, wherein the actuation lever input arm has a first free input arm end facing away from the actuation lever output arm, and has a second input arm end facing the actuation lever output arm; and the actuation lever output arm has a first free output arm end facing away from the actuation lever input arm and a second output arm end facing the actuation lever input arm.

12. The vehicle door lock according to claim 11, wherein the actuation lever input arm has an actuation lever driving surface actuated by the actuating element of the second release device, the end of which is arranged in a region of an input arm perimeter wall of the free input arm end facing the stop lug.

13. The vehicle door lock according to claim 12, wherein the drive elements are designed in the form of extension strips respectively arranged at the second input arm end and respectively attached to an input arm lateral surface and extending out from said lateral surface.

14. The vehicle door lock according to claim 13, wherein the extension strips respectively have an L-shaped progression, when viewed in a direction vertically to the two actuation lever lateral surfaces, wherein a first L-shaped leg comprises a strip driving surface, which points in the direction of the stop lug, arranged vertically to the input arm lateral surface and generally parallel to the actuation lever driving surface, and a second L-shaped leg includes an interior surface that points to the first L-shaped leg and is angled toward the strip driving surface, wherein the interior surface merges via an inner edge surface, which is bent in concave manner, into the strip driving surface such that the extension strips respectively form a continuous interior surface.

15. A vehicle door lock according to claim 10, wherein the stop lug comprises a first stop lug wall integrally molded to the input arm perimeter wall and a second stop lug wall integrally molded to an output front wall of the actuation lever output arm, wherein in the non-actuated position of the actuation lever the stop lug is adjoining a front wall of the lock case by means of its second stop lug wall, as a result of which the rotary motion of the actuation lever against the actuation lever actuating direction is blocked.

16. The vehicle door lock according to claim 10, wherein the actuation lever comprises a support section arranged in the transition region of the actuation lever input arm, the actuation lever output arm and the stop lug, the support section including an actuation lever mounting recess for rotatably supporting the actuation lever about the actuation lever rotary axis.

17. The vehicle door lock according to claim 16, wherein the support section has two cylindrical bearing bushes that respectively extend out from one of the two actuation lever lateral surfaces, in which the actuation lever mounting recess is formed, which extends from one front wall of one bearing bush through the actuation lever all the way to the front wall of the opposite bearing bush.

18. The vehicle door lock according to claim 11, wherein the actuation lever output arm has at its free output arm end an actuating element configured to actuate the locking pawl.

19. The vehicle door lock according to claim 18, wherein the actuating element has an actuating bar and an actuating lug arranged vertically to the actuating bar and pointing in the direction of the stop lug, wherein the actuating bar has a respective actuation surface on an actuating bar interior surface on both sides of the actuating lug.

20. The vehicle door lock according to claim 17, wherein the actuation lever engages with the actuating element in the lock case through a lever pass-through recess provided in the cover of the lock case.

21. The vehicle door lock according to claim 6, wherein the actuation lever is in direct connection or can be brought in direct connection with the actuating element to be driven about the actuation lever rotary axis in the actuation lever actuating direction.

22. A vehicle door lock according to claim 4, wherein the actuation lever actuating direction passes in the opposite direction of the drive lever actuating direction.

23. The vehicle door lock according to claim 1, wherein the rotary latch arrangement has two rotary latches and two locking pawls, wherein one of the locking pawls interact with one of the rotary latches and locks the same.

24. The vehicle door lock according to claim 23, wherein the locking pawls have on one end a respective pawl actuating portion and on the other end a respective pawl mounting portion, wherein in the region of the pawl mounting portion the locking pawls are respectively pivoted about a pawl rotary axis, and at the end of the actuating portion the locking pawls have a respective actuating projection that extends toward the rotary latches and forms a supporting surface for the actuation lever.

25. The vehicle door lock according to claim 24, wherein the locking pawls are in direct connection or can be brought in direct connection with the actuation lever to be driven about the pawl rotary axis in a pawl actuating direction.

26. The vehicle door lock according to claim 1, wherein the lock is configured for locking and closing doors of agricultural machines or construction vehicles.

* * * * *